US006203666B1

(12) United States Patent
Hanaya

(10) Patent No.: US 6,203,666 B1
(45) Date of Patent: Mar. 20, 2001

(54) METHOD AND DEVICE FOR PAPER WEB MANUFACTURING

(75) Inventor: Morimasa Hanaya, Mishima (JP)

(73) Assignee: Tokushu Paper Mfg. Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/149,818

(22) Filed: Sep. 8, 1998

(30) Foreign Application Priority Data

| | | |
|---|---|---|
| Sep. 9, 1997 | (JP) | 9-261011 |
| Oct. 16, 1997 | (JP) | 9-299446 |
| Dec. 17, 1997 | (JP) | 9-364020 |

(51) Int. Cl.[7] ..... D21F 1/48

(52) U.S. Cl. ..... 162/217; 162/217; 162/363; 162/364; 162/368; 162/357; 492/48; 492/20; 492/7; 29/895.23

(58) Field of Search ..... 162/318, 319, 162/217, 363, 368, 367, 372, 272, 273, 274, 357, 364; 492/48, 20, 7; 29/895.23

(56) References Cited

U.S. PATENT DOCUMENTS

| | | | |
|---|---|---|---|
| 3,291,682 | | 12/1966 | Hellstrom . |
| 3,409,139 | | 11/1968 | Jackson et al. . |
| 3,472,733 | * | 10/1969 | Holt ..... 162/301 |
| 5,784,961 | * | 7/1998 | Lorig ..... 101/373 |

FOREIGN PATENT DOCUMENTS

| | | |
|---|---|---|
| 3102496 | 8/1982 | (DE) . |
| 19505572 | 5/1996 | (DE) . |
| 32-9102 | 10/1957 | (JP) . |
| 41-5806 | 3/1966 | (JP) . |
| 50-111302 | 9/1975 | (JP) . |
| 56-8264 | 1/1981 | (JP) . |
| 64-52896 | 2/1989 | (JP) . |
| 8-209577 | 8/1996 | (JP) . |

OTHER PUBLICATIONS

Patent abstract of Japan vol. 13, No. 207 (E–758), May 16, 1989 & JP 01 023782, Jan. 26, 1989.

* cited by examiner

*Primary Examiner*—Stanley S. Silverman
*Assistant Examiner*—Mark Halpern
(74) *Attorney, Agent, or Firm*—Dilworth & Barrese

(57) ABSTRACT

In the present invention, in a process in which a fiber suspension supplied in a flat layer manner is subjected to natural dehydration, pressure dehydration, or suction dehydration, while circulating a cylindrical suction cylinder, and thereby, dehydration slowly proceeds and a paper web is formed, and this paper web is moved to an endless felt by means of a suction couch roll to produce paper, a tapered suction roll sleeve 6, the outer peripheral surface of which is cylindrical and the inner peripheral surface of which has an inclination identical to that of the outer circumference of the tapered suction roll cell 5 is attached and detached, and thereby, it becomes easy to conduct the attachment and detachment of various types of wires wound on tapered suction roll sleeve 6.

47 Claims, 18 Drawing Sheets

METHOD AND DEVICE FOR PAPER WEB MANUFACTURING

BACKGROUND ART

1. Technical Field of the Invention

The present invention relates to the manufacture of sheet form articles having paper webs, such as paper or wet non woven cloths or the like, and in particular, relates to a method and device for the manufacture of paper webs, and further relates to an exchange method for forming wires and the like.

2. Background Art

In conventional paper web manufacturing methods, various types of specialized formers were employed using fourdriniers and cylinder formers as a base, such as on-top formers, twin wire formers, inclined wire formers, suction cylinder formers, and the like. Furthermore, in conventional cylinder formers, as the speed increased, centrifugal force tended to operate, and the paper web formation became disordered, so that it was necessary to either apply a suction force to the inner surface of a cylinder mold or to apply a pressurizing force to the outer surface of the cylinder mold in order to reach a balance with the centrifugal force. For this reason, various types of suction, pressurization, and depressurized or pressurized cylinder formers have been developed.

In all of these depressurized or pressurized cylinder molds a backing wire (commonly having a mesh within a range of 8–16) and a face wire (commonly having a mesh within a range of 50–80) are wound and affixed using silver solder to the outer circumference of a cylinder having a suction roll structure; however, fibers present in the paper stock, resin, sizing agent, filler and the like tend to be deposited in the gaps in the wires. Accordingly, particularly during times when paper stock is employed to which is added a large amount of filler (titanium dioxide, talc, calcium carbonate), the filler is the source of blockages in the openings of the wire or the suction roll, so that it is necessary to repeatedly stop the machinery and to clean the wire or the suction roll, or to exchange the wire, so that this creates a problem in that the operational efficiency declines. In particular, when suction rolls are employed, it is necessary to remove the roll cell, and to open the blockages in the opening one by one by inserting a hand-operated drill into the holes of the roll cell, so that the operational efficiency declines dramatically. For this reason, cylinder formers normally employ almost no filler, and are employed in the making of paper such as tissue paper, paper board, filter paper, or paper for electrolytic condensers.

However, in the case of paper for certificates, various types of paper for gold notes, paper for bank notes, and the like, there are limits to the expressive power of watermarks formed by suction box parts, or dandy rolls on a fourdrinier, so that it is still the case that watermarks produced by methods employing cylinder formers are employed.

However, when a method using a cylinder former to make watermarked papers is employed, the surfaces must always be kept perfectly circular, and the structure must be strong, so that both the face wire and backing wire are completely silver soldered to both end parts of the cylinder mold or the main body of the dandy roll, and removal thereof is difficult. Accordingly, it is difficult to prepare a plurality of varied cylinder molds or dandy rolls corresponding to the finished dimensions of the watermark design or the sheets, to exchange the cylinder molds with each respreading, and in order to maintain cleanliness, to store these in a storehouse or the like, and as a result, it is not merely the case that the exchange of the cylinder molds or the dandy rolls is a time consuming process, but the efficiency of use of the cylinder molds or dandy rolls is low, and there is also a problem in that a large amount of space is required for the storage of the cylinder molds or the dandy rolls.

SUMMARY OF THE INVENTION

In order to solve the problems described above, the present inventors have conducted investigations into methods and devices for paper web manufacturing for cylindrical face wires or dandy rolls or suction rolls in which, by means of appropriately detaching an outer sleeve and altering the diameter of the cylinder molds or dandy rolls, it becomes possible to remove the face wire of the cylinder mold or dandy roll and exchange it for a different face wire, and as a result, instantaneous responses are possible to changes in the production conditions, such as the type or freeness of the pulp, the temperature, the density, fillers, the amount of chemical additives, the type or weight of the paper, the watermark pattern or dimensions, or the speed of production.

As a result, in the process of production using a fiber suspension supplied in a flat film shape while rotating a cylindrical suction cylinder by gradually promoting dehydration using natural dehydration, pressurized dehydration, or suction dehydration and forming a paper web, and then moving the paper web to an endless felt by means of a suction couch roll, by detaching a tapered suction roll sleeve having an inner surface with the same inclination as the outer circumference of the tapered suction roll cell and having a cylindrical outer peripheral surface, it is a simple matter to execute the attachment and detachment of a variety of wires, and this solves the problems described above.

BRIEF DESCRIPTION OF THE DIAGRAMS

BEST MODE FOR CARRYING OUT THE INVENTION

Hereinbelow, the present invention will be explained in detail with reference to the figures. In this invention, the "tapered suction roll cell" indicated by reference no. 5 and the "tapered suction roll sleeve" indicated by reference no. 6 are used only in the case of use as a suction type cylinder mold in a method in which vacuum pressure operates positively on the inner side of the cylinder mold. Accordingly, when vacuum pressure does not operate positively on the inner side of the cylinder mold, these should simply be termed "tapered roll cell main body" and "tapered roll sleeve". Furthermore, in the same manner, the "drainage" of the "central drainage pipe" indicated by reference no. 2 is only used for suction type cylinder mold, so that when non suction type cylinder mold are employed, this should simply be termed a "central pipe".

Figure 1:
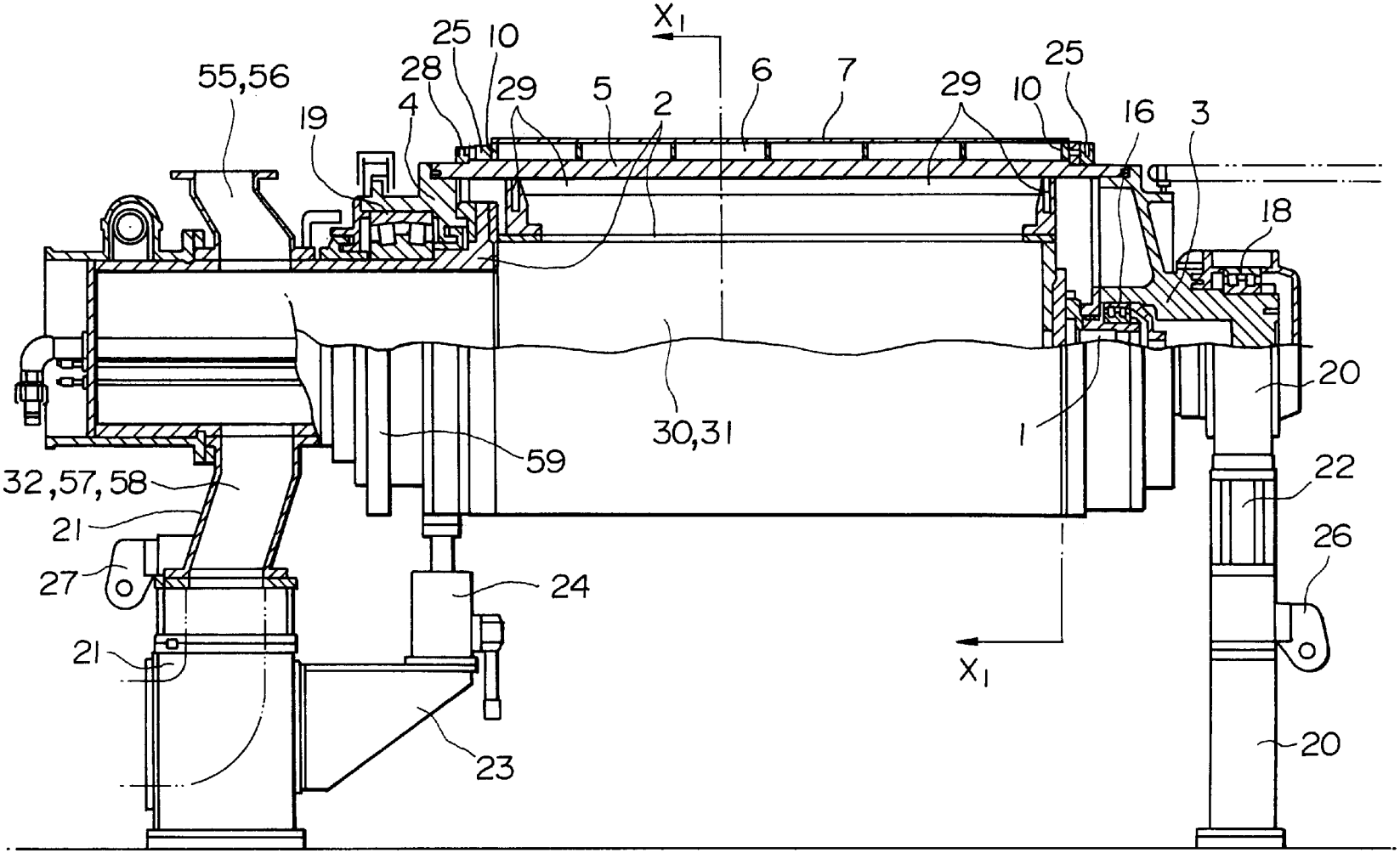
FIG. 1 is a side view and partial vertical cross-sectional view of a paper web manufacturing device in accordance with the present invention.

FIG. 1 is a partial vertical cross-sectional view showing an example of a paper web device in accordance with the present invention; this shows the state in which the tapered suction roll sleeve is installed. Furthermore, FIG. 2 is a partial horizontal cross-sectional view taken along the line $X_1$—$X_1$ in FIG. 1.

Figure 2:
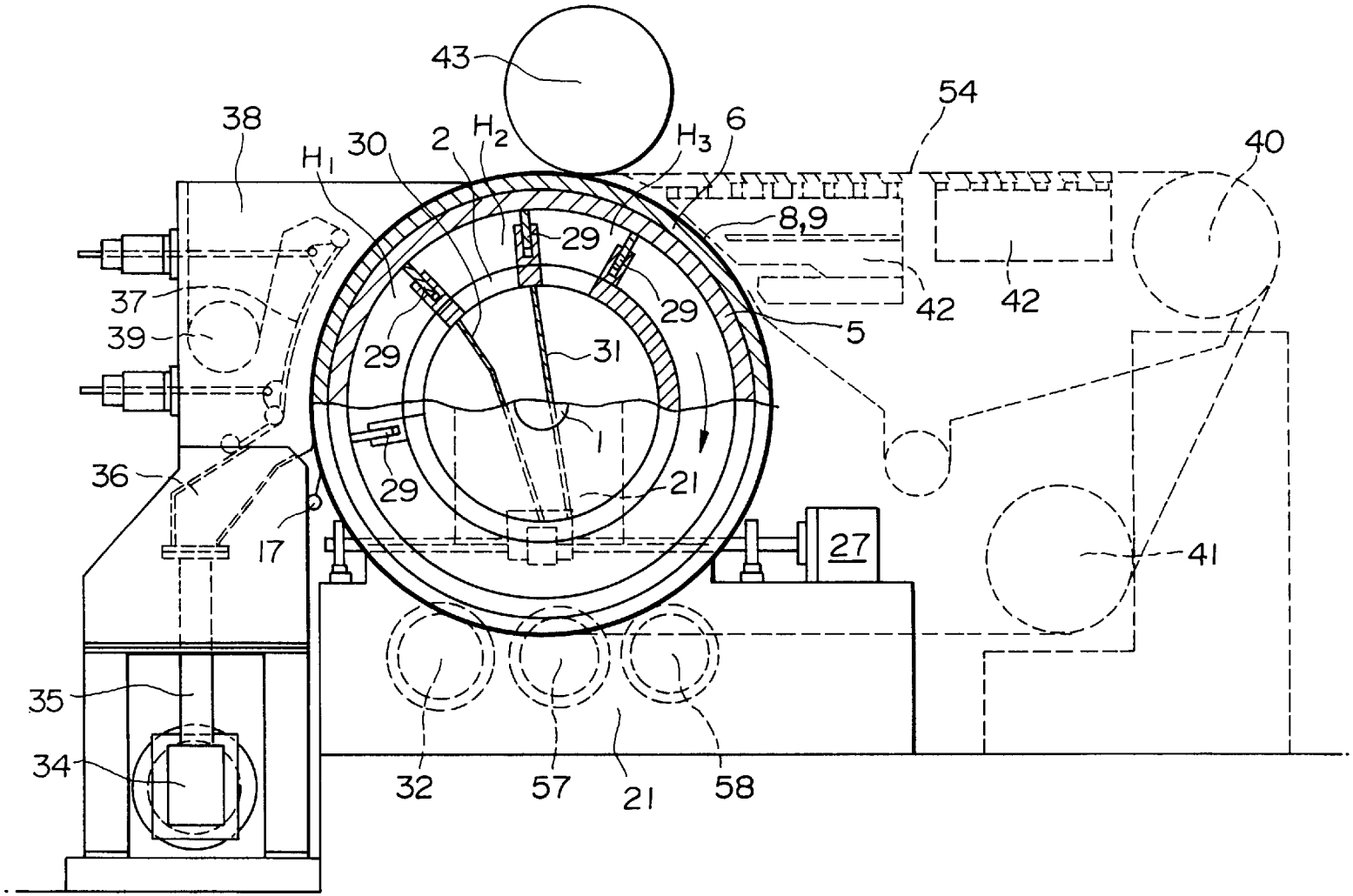
FIG. 2 is a cross-sectional view taken along the line $X_1$—$X_1$ in FIG. 1 of a paper web manufacturing device in accordance with the present invention.

In FIGS. 1 and 2, reference no. 1 in the figure indicates a central fixed shaft 1 which is a non-rotating member; in the central portion of the cylinder main body, a central drainage pipe (hollow shaft) 2, which has an opening with a large aperture and serves to conduct drainage, is coaxial with central fixed shaft 1, and is provided in a non-rotating manner. Openings divided into a number of sections are formed in the outer peripheral surface of the central drainage pipe 2, and at the outer circumference thereof, a tapered suction roll cell 5 is supported so as to be coaxial. Furthermore, at the operational side (the right side in FIG. 1), the central fixed shaft 1 is affixed to operational side frame 20, passing through the housing of the operational side rotational axle 3 or through the operational side rotational axle 3. A distance piece 22 for wire withdrawal which can be withdrawn using a hydraulic jack is provided in order to insert face wire 9, backing wire 8, or a wire 54 for a short wire former with a suction cylinder or a suction breast into operational side frame 20.

On the drive side (the left side in FIG. 1), the central drainage pipe 2 is affixed to the drive side frame 21. Furthermore, at the outer circumferencial side of both end parts of the central drainage pipe 2, both ends of the tapered suction roll cell 5 are supported on drive side frame 21 and operational side frame 20, via, respectively, the drive side rotational axle bearing 19 and the drive side rotational axle 4 on the drive side, and on the operational side, via operational side rotational axle bearing 18 and operational side rotational axle 3. The outer peripheral surface of the tapered suction roll cell 5 is preferably inclined by, for example, 0.5° in the direction of the operational side, and has the form of a conical tube. And reference no. 17 is a high pressure shower which sprays water on the tapered suction roll cell 5.

When a pattern having a constant size is to be laid down at a constant pitch, it is necessary to provide a cylinder mold for production which has an outer diameter such that the length of the circumference corresponds to the pitch of the watermark design.

An example of the structure of the tapered suction roll sleeve 6 is shown in FIGS. 3A, 3B, and 4A, 4B. In these examples, the tapered suction roll sleeve 6 is divided into two or more parts and comprises cylindrical suction cylinder perforated shells 7 which are freely extendible in the inner and outer circumferencial directions by a connecting mechanism comprising connection fittings 12, connection pins 13, and tapered holes 14. During installation, the distance between the connecting pins of the suction cylinder perforated shells 7, the connecting parts of which were previously brought into proximity, is reduced by means of a turnbuckle, and the diameter is reduced, and after placing on the outer peripheral surface thereof a backing wire 8 having an endless structure and an face wire 9 having an endless structure and having the watermark design thereon, the connecting parts are released, and the diameter is expanded as a result of its own weight. Additionally, the tapered suction roll sleeve 6 is inserted using the tapered suction roll sleeve sliding device 25 to a point at which the wire is stretched with a predetermined tensile force while sliding, preferably from the operational side of the tapered suction roll cell 5, and is then affixed using tapered suction roll sleeve affixing device 28.

Figure 3B:
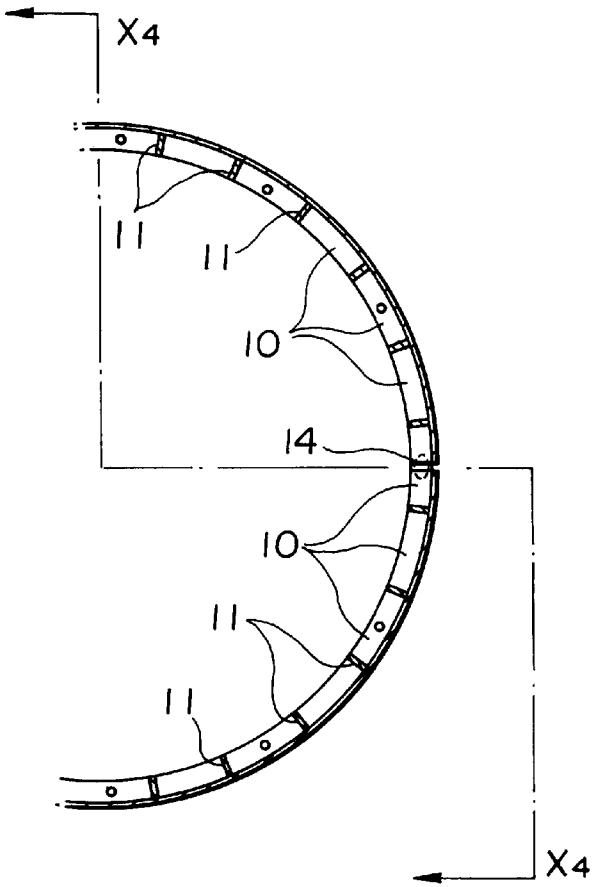
FIG. 3B is a partial horizontal cross-sectional view showing an example of a tapered suction roll sleeve in accordance with the present invention.
Figure 3A:
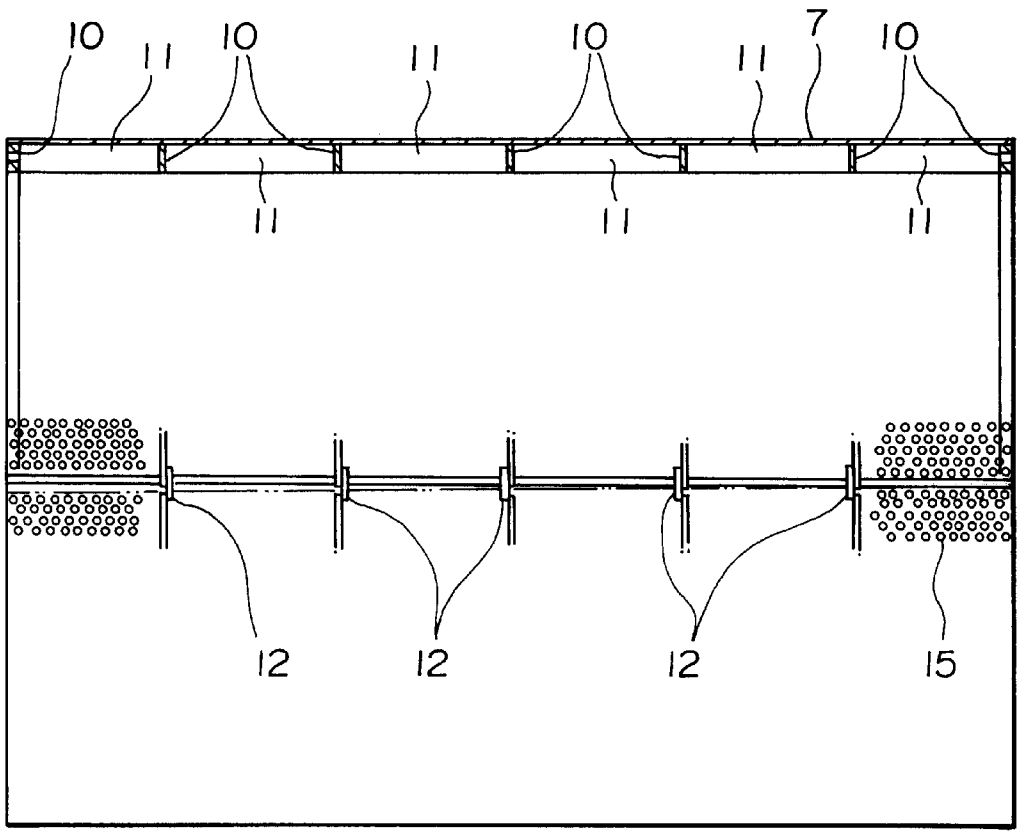
FIG. 3A is a cross-sectional view taken along the line $X_4$—$X_4$ in FIG. 3B showing an example of a tapered suction roll sleeve in accordance with the present invention.

In the tapered suction roll sleeve 6 shown in FIGS. 3A, 3B, a plurality of two-piece rings 10 which are made up of two pieces are arranged in approximately in a semicircle at equal spacings along the axial direction, and the intervals therebetween are linked by axial direction reinforcing ribs 11, and furthermore, this structure is affixed at approximately equally spaced points to the inner peripheral surface of the cylinder perforated shell 7 having a plurality of holes 15; by means of this structure, a pair of semicircular tubes are formed which have the required width and outer diameter and which have an inner diameter and inclination approximately equivalent to those of the outer circumference of the tapered suction roll cell, which is inclined in the shape of a conical tube.

Figure 4B:
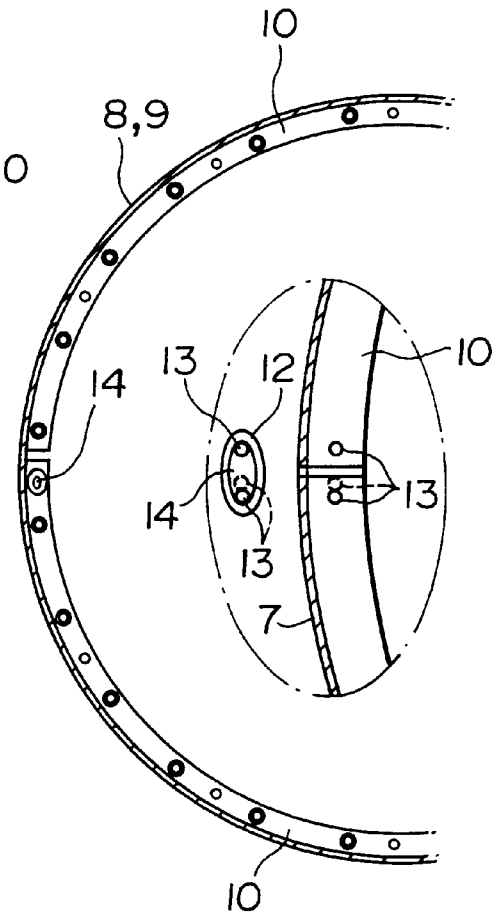
FIG. 4B is a partial horizontal cross-sectional view showing an example of a tapered suction roll sleeve in accordance with the present invention. Within the cylinder, an expanded view of the tapered hole and the connecting pins is shown.
Figure 4A:
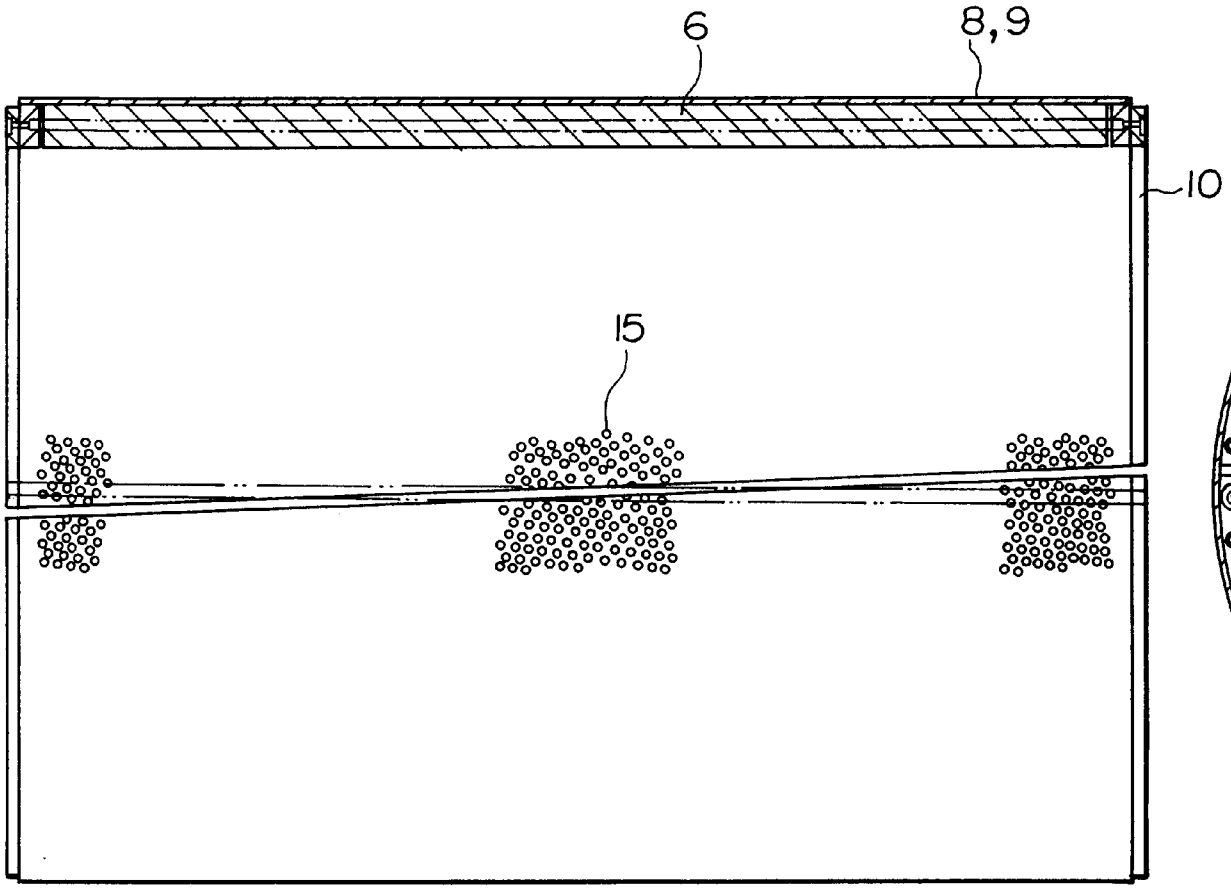
FIG. 4A is a side view and a partial vertical cross-sectional view showing an example of a tapered suction roll sleeve in accordance with the present invention.

The tapered suction roll sleeve 6 shown in FIGS. 4A, 4B is a unitary product formed by the bending or casting of low specific gravity aluminum, the molding of low specific gravity engineering plastic, the molten extraction of nylon, or the mandrel wrapping of carbon fibers. In this example, the tapered suction roll sleeve 6 is formed as a pair of semicircular pipes having a plurality of holes 15 in the outer peripheral surfaces thereof. Furthermore, in order to facilitate the replacement operation of the tapered suction roll sleeve 6, a plurality of void grooves may be provided in the inner peripheral surfaces thereof to reduce the weight.

Figure 5A:
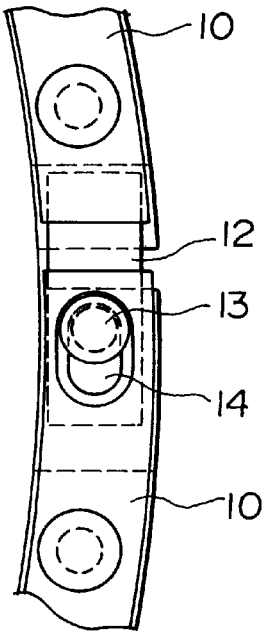
FIG. 5A is a partial horizontal view showing an example of the structure of the connecting parts of the ring of a tapered suction roll sleeve in accordance with the present invention.
Figure 5B:
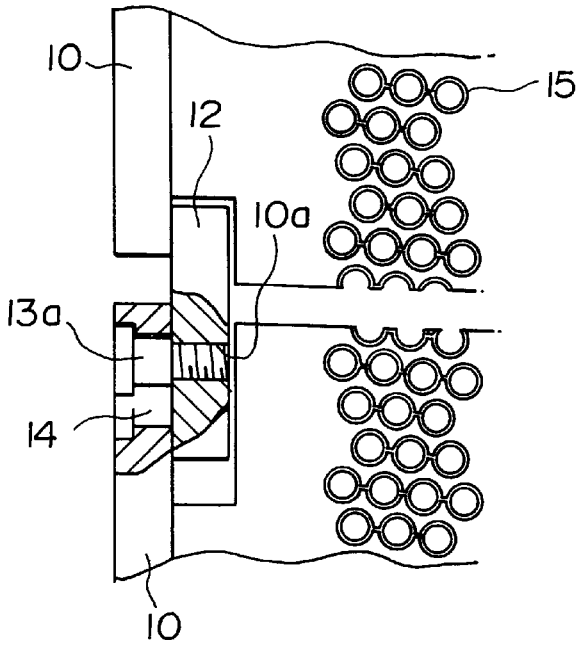
FIG. 5B is a partial vertical cross-sectional view showing an example of the structure of the connecting parts of the ring of a tapered suction roll sleeve in accordance with the present invention.

Furthermore, as shown in FIGS. 5A, 5B, at the connecting parts of two facing two-piece rings 10, a connection fitting 12 which overlaps a part of one ring 10 (in the FIGS. 5A, 5B, the upper ring) is provided, and a screw hole 10*a* is provided in the lower part of this. Furthermore, at the point of connection with the other ring 10 (in the FIGS. 5A, 5B, the lower ring), an affixing tapered hole 14 is provided, and by screwing the male thread of the lead end of a connection pin 13 which is inserted into this affixing tapered hole 14 into the screw hole 10*a,* the two two-piece rings 10 are connected in a unitary manner. As shown in FIGS. 5A, 5B, and 6A, 6B, in top view, the affixing tapered hole 14 has an inner diameter which is approximately equal to the outer diameter of the head part 13*a* of the connecting pin 13, and the width thereof slowly increases in the direction of the top of the hole, so that the hole is elongated in shape. Accordingly, from the state shown in FIGS. 6A, 6B in which the upper and lower two-piece rings 10 are in close proximity, by achieving the widened diameter state shown in FIGS. 5A, 5B in which the upper and lower rings 10 are separated from one another, the head part 13*a* of the connecting pin is guided an end part (upward part in FIGS. 5A, 5B, 6A, 6B) along affixing tapered hole 14. In this part, the position of the head part 13 with respect to the affixing tapered hole 14 is accurately set, so that the circularity of the tube formed by the upper and lower two-piece rings 10 can be guaranteed.

Figure 6A:
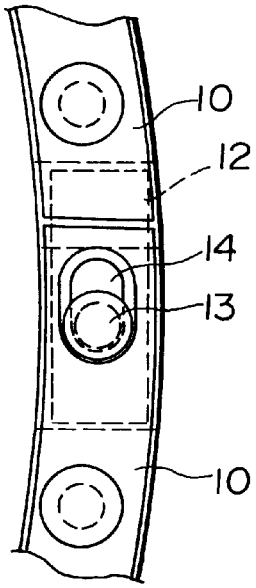
FIG. 6A is a partial horizontal view showing an example of the structure of the connecting parts of the ring of a tapered suction roll sleeve in accordance with the present invention.
Figure 6B:
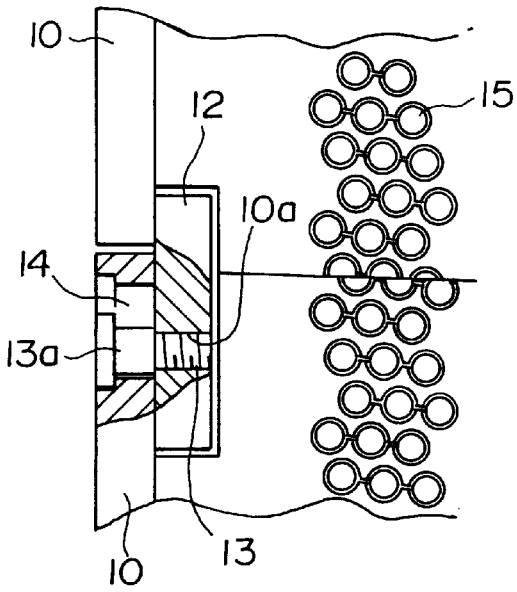
FIG. 6B is a partial vertical cross-sectional view showing an example of the structure of the connecting parts of the ring of a tapered suction roll sleeve in accordance with the present invention.

In another example of the structure of a tapered suction roll sleeve 6, both ends of the two-piece rings 10 described above are extended slightly in an arc shape, and in the same manner as in the examples shown in FIGS. 5B and 6B, a connecting pin 13 is screwed into screw hole 10*a* formed in the extended part, and upper and lower two-piece rings 10 are separated to form an expanded diameter state, and thereby, it is possible to guarantee the circularity of the tube formed by the two-piece rings 10.

In the connecting parts of the cylinder perforated shell 7, which is divided into two or more parts, during paper web formation, the water passing through the sheet flows directly to the tapered suction roll cell 5 through face wire 9 and backing wire 8, so the total filtration resistance is low, and the amount of filtered water increases, and a joint mark is likely to appear at the paper web formed at these positions. Accordingly, as shown by dotted line in FIG. 4A, by ensuring that a joint does not appear by inclining the outer fringe parts of the neighboring cylinder perforated shells 7 in the direction of rotation, or by forming these in the shape of a ladder with a zig zag form, or by extending a portion thereof in a step structure (with the exception of those parts at which connecting mechanisms are installed), it is possible to equalize the total filtration resistance, so that a joint mark does not appear.

Another example of the structure of the tapered suction roll sleeve 6 is shown in FIGS. 7A, 7B and 8A, 8B. In these examples, cylindrical tapered suction roll sleeves 6 having various outer diameters corresponding to the watermark designs are prepared, and after a backing wire 8 having an endless structure and a face wire 9 having an endless structure and which is provided with a watermark design are placed on the outer peripheral surface thereof, this sleeve is inserted in a sliding manner in the tapered suction roll cell 5 by tapered suction roll sleeve sliding device 25 to a predetermined position, preferably from the operational side, and is affixed.

Figure 7B:
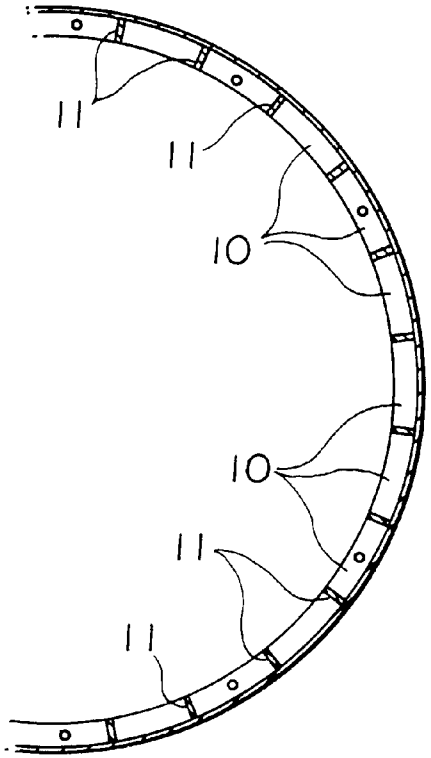
FIG. 7B is a partial horizontal cross-sectional view showing an example of a tapered suction roll sleeve in accordance with the present invention.
Figure 7A:
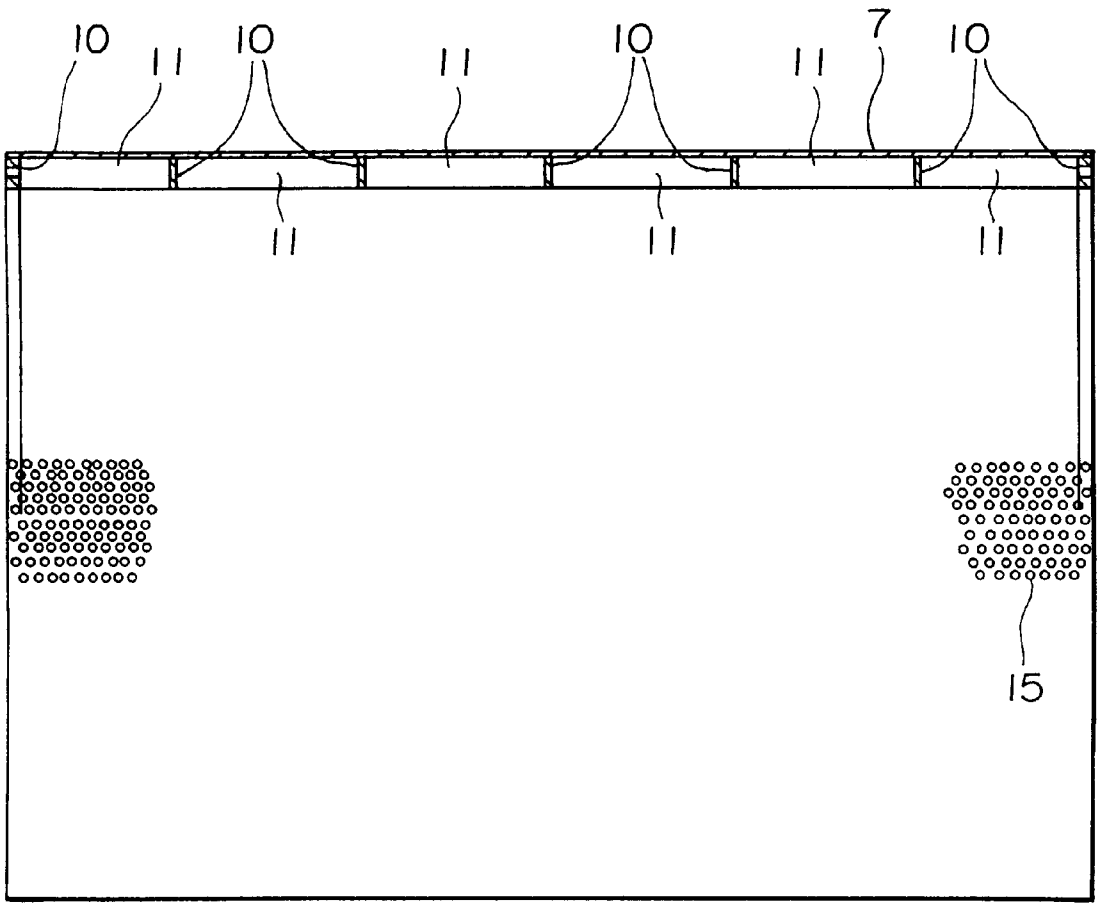
FIG. 7A is a side view and a partial vertical cross-sectional view showing an example of a tapered suction roll sleeve in accordance with the present invention.

In the tapered suction roll sleeve 6 shown in FIGS. 7A, 7B, the rings 10 and the axial direction reinforcing ribs 11 are having identical outer diameters and the inner circumferences of which decrease in a stepwise fashion, and are approximately circular. These rings 10 and ribs 11 are affixed to the inner peripheral surface of the cylinder perforated shell 7 which has a plurality of holes 15, and this forms a perforated cylinder provided with an inner circumferencial taper having an inner diameter and inclination approximately equal to that of the outer circumference of the tapered suction roll cell 5, which is inclined in the shape of a conical tube, and having the necessary width and outer diameter.

Figure 8B:
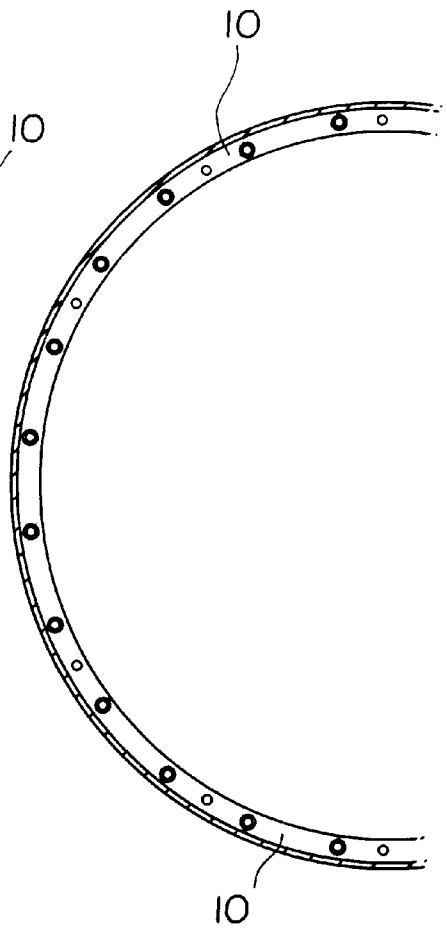
FIG. 8B is a partial horizontal cross-sectional view showing an example of a tapered suction roll sleeve in accordance with the present invention.
Figure 8A:
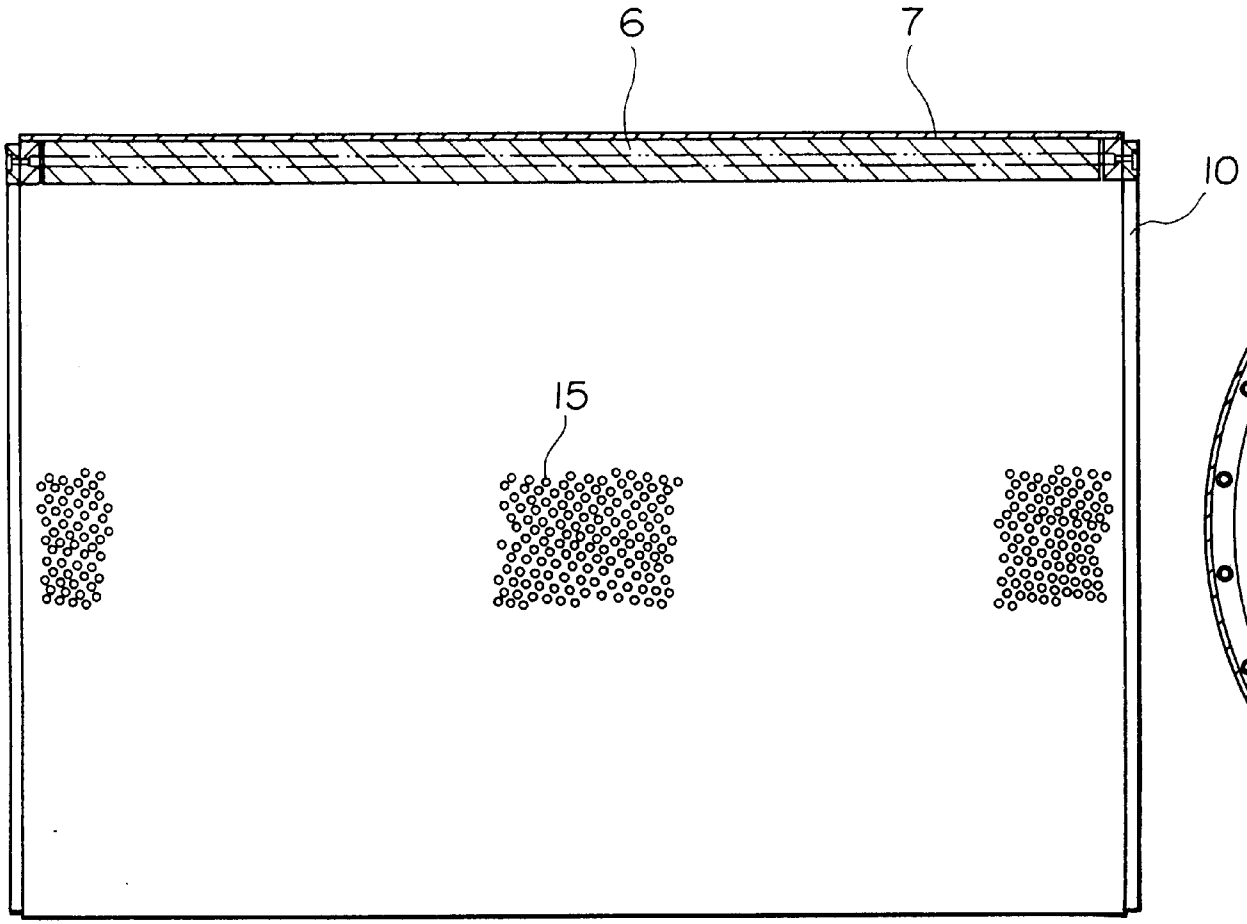
FIG. 8A is a side view and a partial vertical cross-sectional view showing an example of a tapered suction roll sleeve in accordance with the present invention.

The tapered suction roll sleeve 6 shown in FIGS. 8A, 8B, is a unitarily formed member produced by the bending of low specific gravity aluminum, the molding of low specific gravity engineering plastic, the molten extraction of nylon, or the mandrel wrapping of carbon fibers. In this case, the tapered suction roll sleeve 6 is formed in a tubular shape having a plurality of holes 15 in the outer peripheral surface thereof. Furthermore, in order to facilitate the exchange operation of the tapered suction roll sleeve 6, a plurality of void grooves may be provided in the inner peripheral surface thereof to reduce the weight.

In this example, it is difficult to guarantee the accuracy of the finished taper of the inner peripheral surface of the tapered suction roll sleeve 6 over the entirety thereof, so that by the use of nip pressure and flexible materials in the sleeve, the inner diameter of the central part may be made slightly large, and the accuracy may be maintained at least at both end parts. Furthermore, the tapered suction roll sleeve 6 may be supported by the tapered suction roll cell 5 not over the entire surface of the inner circumference thereof, but rather at a plurality of points.

Furthermore, a plurality of nearly circular rings 10, which have the same outer diameter and the inner diameters of which decrease in a stepwise fashion, may be affixed at essentially equal spacing to the axial direction reinforcing ribs 11, and wire may be wrapped around the outer circumference thereof, to form a perforated cylinder having an inner circumferencial taper, which has the necessary width and outer diameter, and which has an inner circumferencial diameter and inclination which are approximately identical to those of the outer circumference of the tapered suction roll cell 5, which has the shape of a conical tube.

In each example described above, when a rolled aluminum plate or cast aluminum is employed as the material for the tapered suction roll sleeve 6, in order to accommodate the acidic paper, which has a pH of approximately 4, and the alkaline cleaning, which has a pH of approximately 12, it is necessary to conduct non-electrolytic nickel plating (with a plating thickness within a range of 30–50 micrometers). Furthermore, during this plating, in order to maintain a constant plating thickness, it is desirable that the tapered suction roll sleeve 6 be rotated or moved in an upward and downward manner in the plating bath. Furthermore, in order to increase the surface strength of the plating layer, it is desirable that baking be conducted for approximately 3 hours before and after plating at a temperature such that the tapered suction roll sleeve 6 will not experience thermal warping (for example, within a range of 130–200° C.).

During the withdrawal or insertion of the tapered suction roll sleeve 6, if for example, the taper angle is set to 0.5°, sliding for 26.6 mm in the axial direction will suffice to reduce the diameter by 2 mm in order to remove the backing wire 8 and the face wire 9. Accordingly, when a divided tapered suction roll sleeve 6 such as that shown in FIGS. 3A, 3B and 4A, 4B is employed, if the tapered suction roll sleeve 6 is subjected to sliding for approximately 40 mm, the distance between the connection pins in close proximity at the connecting parts is reduced using a turn buckle or the like, or proximity is achieved using a winding rope wound about a plurality of rope pins, so that the diameter is reduced by approximately 3 mm, and the removal of the vacuum wire 8 and the face wire 9 is facilitated.

On the other hand, when a divided tubular tapered suction roll sleeve 6 such as that shown in FIGS. 7A, 7B and 8A, 8B is employed, the tapered suction roll sleeve 6 need only be subjected to sliding for approximately 40 mm, so that the diameter thus reduced by approximately 3 mm, and the removal of the tapered suction roll sleeve 6 is facilitated. However, the wire is not removed directly, and the exchange of the wire is achieved by the exchange of the tapered suction roll sleeve 6.

Furthermore, the inner peripheral surface of the tapered suction roll sleeve 6 and the outer peripheral surface of the tapered suction roll cell 5 have the same inclination. Accordingly, during the attachment and detachment of the sleeve 6, using a tapered suction roll sleeve sliding device 25 such as a hydraulic nut or a screw nut or the like, sliding is conducted using a tightening coefficient (for example, within a range of 1.4 to 2) such that slippage does not occur along the taper surface, and then the sleeve is affixed to the suction roll 5 using a tapered suction roll sleeve affixing device 28 such as bolts or pins. The tapered suction roll sleeve 6 is inserted and extracted from the operational side, so that it is preferable that the operational side tapered suction roll sleeve sliding device 25 be made attachable and detachable.

Figure 9:
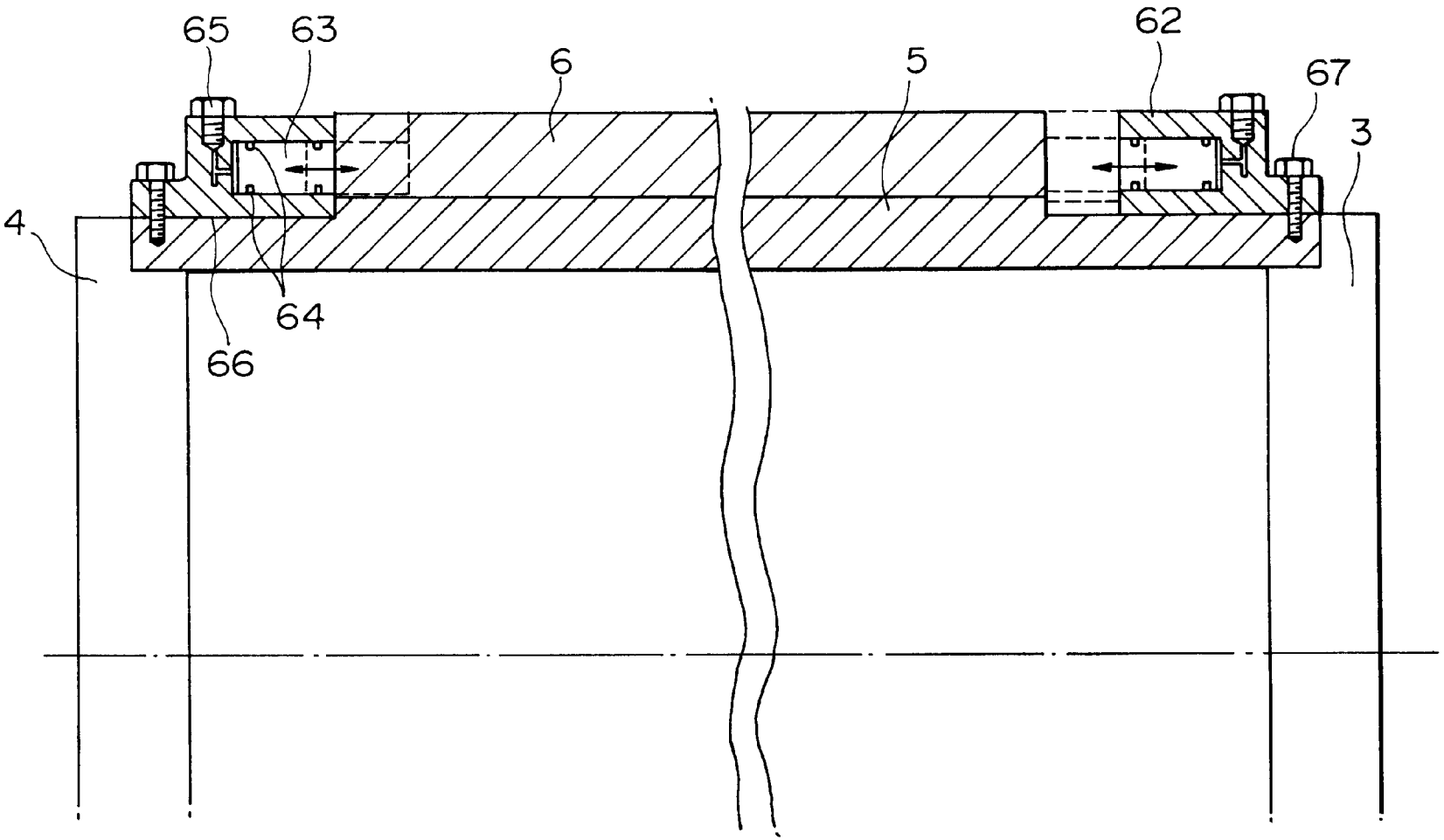
FIG. 9 is a side view and a partial vertical cross-sectional view showing another example of a wire support method using a tapered suction roll sleeve embodying the method of the present invention.

The structure of a hydraulic nut which serves as an example of the tapered suction roll sleeve sliding device 25 or the tapered suction roll sleeve affixing device 28 is shown in FIG. 9. This hydraulic nut is provided with a screw groove 66 on the inner diameter part thereof. An annular plunger 63 is inserted in the groove part of a hydraulic nut main body 62, which has a larger diameter than the tapered suction roll cell 5 and is provided with an annular groove on one end surface thereof, and the inner and outer circumferences are sealed using an O ring 64 so as to be slidable, and a hydraulic joint is provided on the outer diameter part of the nut, and by connecting this with the groove part via an annular hydraulic groove, the plunger 63 is made so as to be slidable for, example, approximately 40 mm in the axial direction.

Furthermore, the hydraulic nut has another structure may be employed. In this hydraulic nut, the screw groove is not provided on the inner diameter part of the hydraulic nut main body 62, and a plurality of affixing seats are provided on the affixing side of the hydraulic nut main body 62, and by means of affixing bolts 67 which are inserted through these affixing seats, the hydraulic nut main body 62 is affixed to the outer circumference of the tapered suction roll cell 5.

When there is a danger of hydraulic fluid leakage, water may be employed in place of the oil of the hydraulic nut, and this water pressure nut may be employed.

When the hydraulic nut is handled, ring shaped plungers 63 are inserted in both axial ends of the tapered suction roll sleeve 6 so as to be capable of making contact, and the affixing side is affixed to the tapered suction roll cell 5 or the operational side rotational axle 3 and the drive side rotational axle 4, and the hydraulic joint 65 comes into contact with a manually operated plunger pump or the like via hydraulic tubing. Additionally, when the tapered suction roll sleeve 6 is removed, the drive side hydraulic nut is pressurized, and the operational side hydraulic nut is removed in advance. On the other hand, when the tapered suction roll sleeve 6 is inserted, the operational side hydraulic nut is pressurized.

A screw nut structure which serves as another example of the tapered suction roll sleeve sliding device 25 is described below. A nut which has a screw groove on the inner diameter part thereof and which is capable of sliding for approximately, for example, 40 mm in the axial direction is inserted into both axial ends of the tapered suction roll sleeve 6 so that the nut end surfaces are capable of coming into contact, and screw surfaces which correspond to the screw grooves are provided on the tapered suction roll cell 5 or the operational side rotational axle 3 and drive side rotational axle 4. Additionally, when the tapered suction roll cell 6 is removed, the drive side screw nut is rotated, and the operational side screw nut is removed in advance. On the other hand, when the tapered suction roll sleeve 6 is inserted, the operational side screw nut is rotated. An appropriate amount of time and labor are required for the removal of the operational side screw nut from the operational side rotational axle 3, so that it is desirable that the attachment and detachment thereof be simplified by making the nut attachable to and detachable from a hinge joint, or by dividing it into two parts.

With respect to the face wire 9 for watermarking, because it is necessary to provide a plurality of cylinder molds having circumference lengths in accordance with the finished dimensions in the various methods, there are also a large variety of diameters of endless face wires 9. It is also necessary to set the diameter of the backing wire 8 in consideration of the diameter and thickness of the corresponding face wire 9, and in consideration of the amount of extension, and to make this backing wire endless. Backing wire 8 and face wire 9 may be made endless by, for example, seam welding.

The tapered suction roll sleeves 6 have a variety of outer diameters appropriate to the variety of diameters present when the face wire 8 and backing wire 9, which were made endless as described above, are placed under a predetermined amount of tensile force, and it is necessary to finish these sleeves by exterior polishing so that the circularity thereof is approximately within a range of 2/100–5/100 mm or less. Accordingly, in the exchange of endless cylinder molds having the same outer diameter, the tapered suction roll sleeve 6 need only be subjected to sliding for approximately 40 mm, as described above; however, in the case of exchange of cylinder molds having differing outer diameters, it is also necessary to exchange the tapered suction roll sleeve 6 for one with a differing outer diameter.

Figure 10:
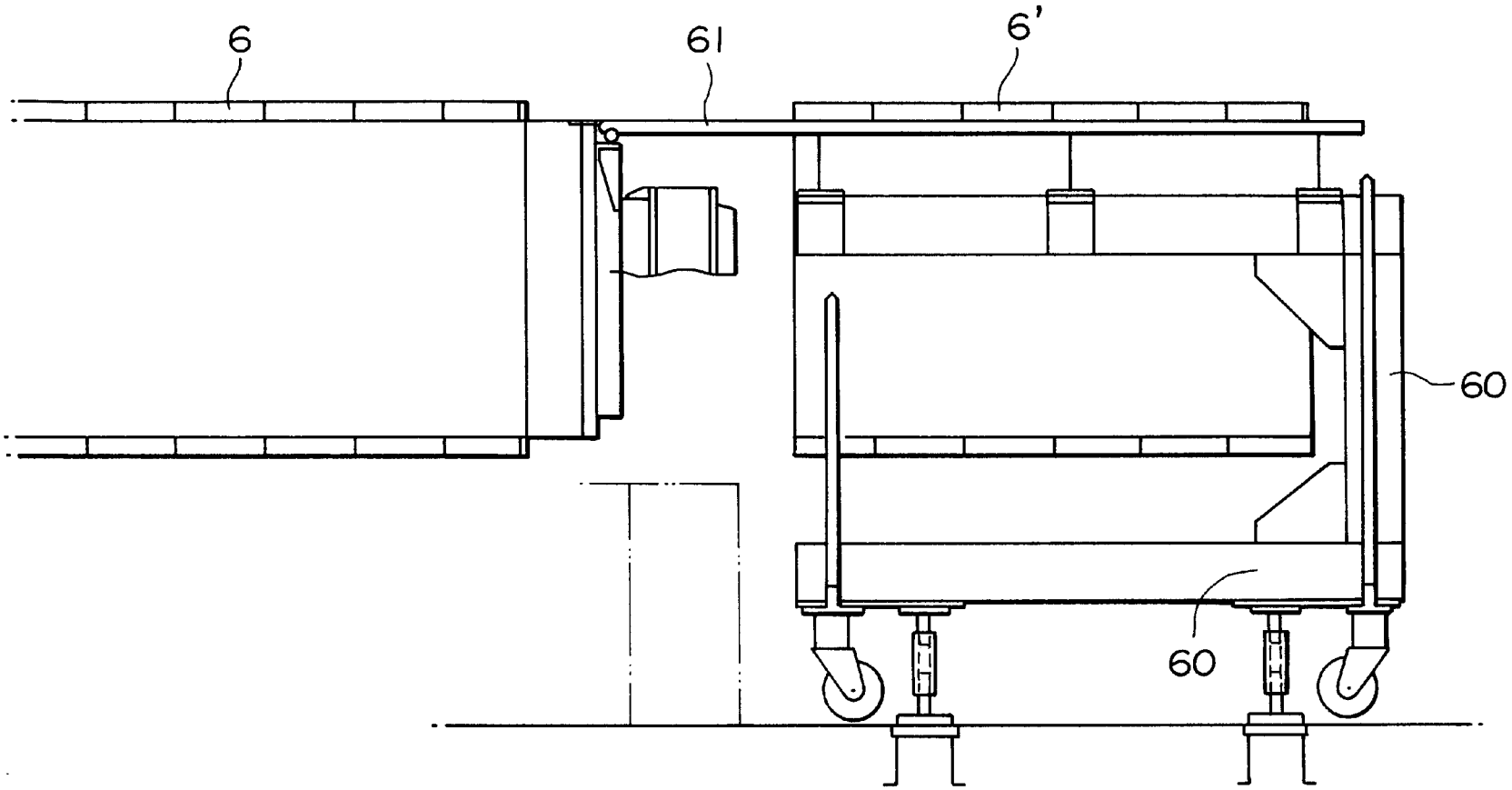
FIG. 10 is a side view showing an example of a removal device for the tapered suction roll sleeve in accordance with the present invention.
Figure 11:
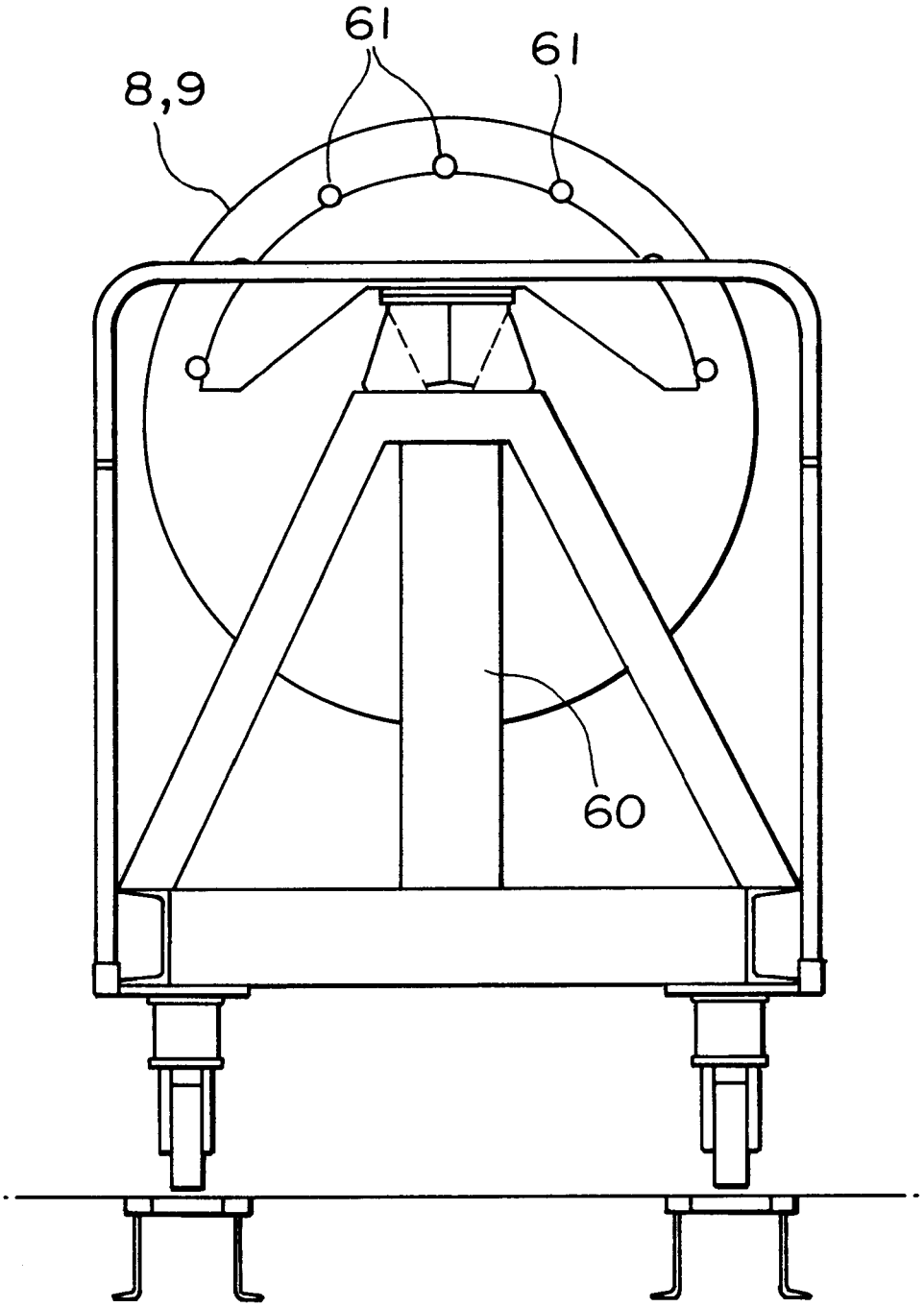
FIG. 11 is a front view showing an example of a removal device for the tapered suction roll sleeve in accordance with the present invention.

In the case of a rotating cylinder mold, the tapered suction roll sleeve 6 is light weight, since the nip pressure at the couch roll is approximately within 5–10 kg/cm, so that the load is comparatively light, and thus manual exchange is possible; however, in order to save labor, a traveling cart such as that shown in FIGS. 10 and 11 is employed. The traveling cart 60 is provided with sleeve or wire exchange rods 61 in a half to one-third arc shape, and the end surface thereof moves parallel to the axial direction on the operating side rotational axle 3, whereby the tapered suction roll sleeve 6 or the backing wire 8 and face wire 9 can be attached and detached from the apparatus. The traveling cart 60 may be motor driven and may stop automatically by means of magnet sensors or the like, and it is thus possible to exchange, in a completely automated manner, the tapered suction roll sleeves 6 or backing wire 8 and face wire 9, by means of automatic picking.

Figure 12:
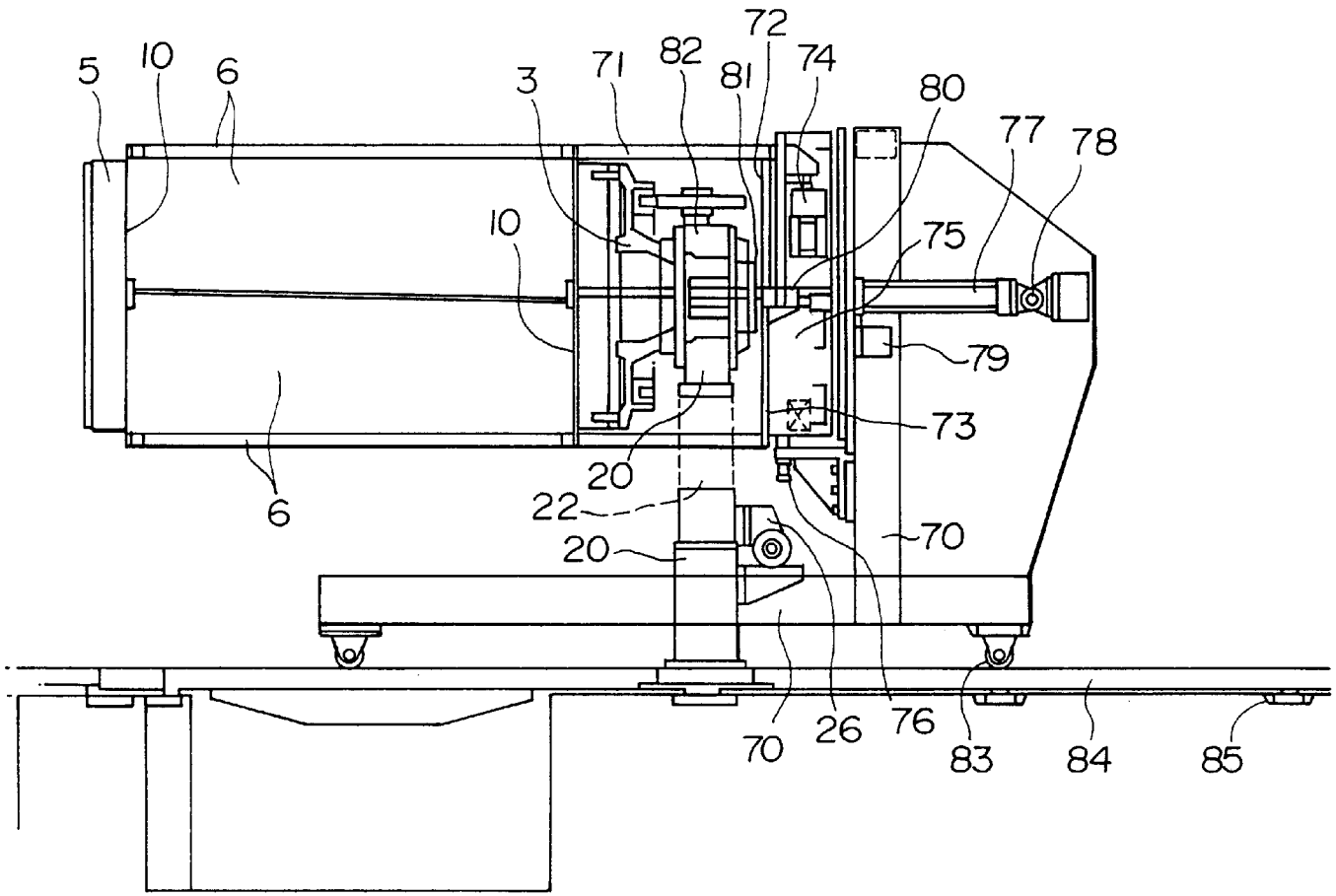
FIG. 12 is a side view showing an example of the removal device for the tapered suction roll sleeve in accordance with the present invention.
Figure 13B:
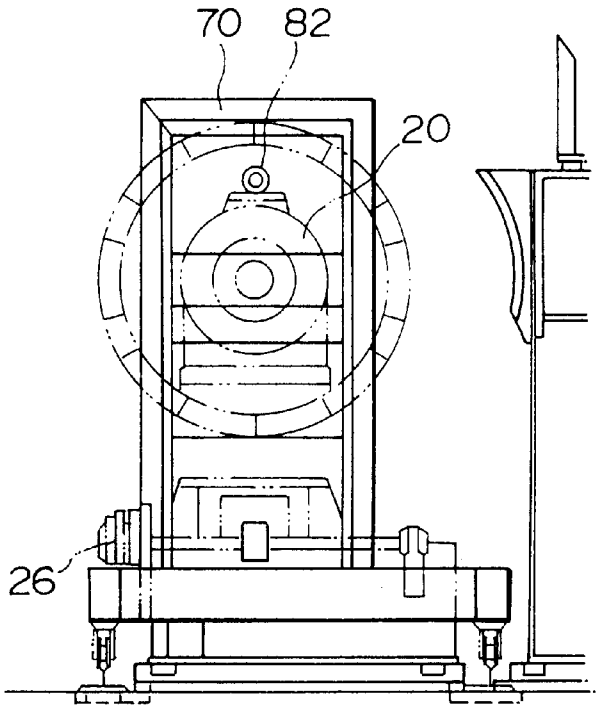
FIG. 13B is a front view showing an example of the removal device for the tapered suction roll sleeve in accordance with the present invention.
Figure 13A:
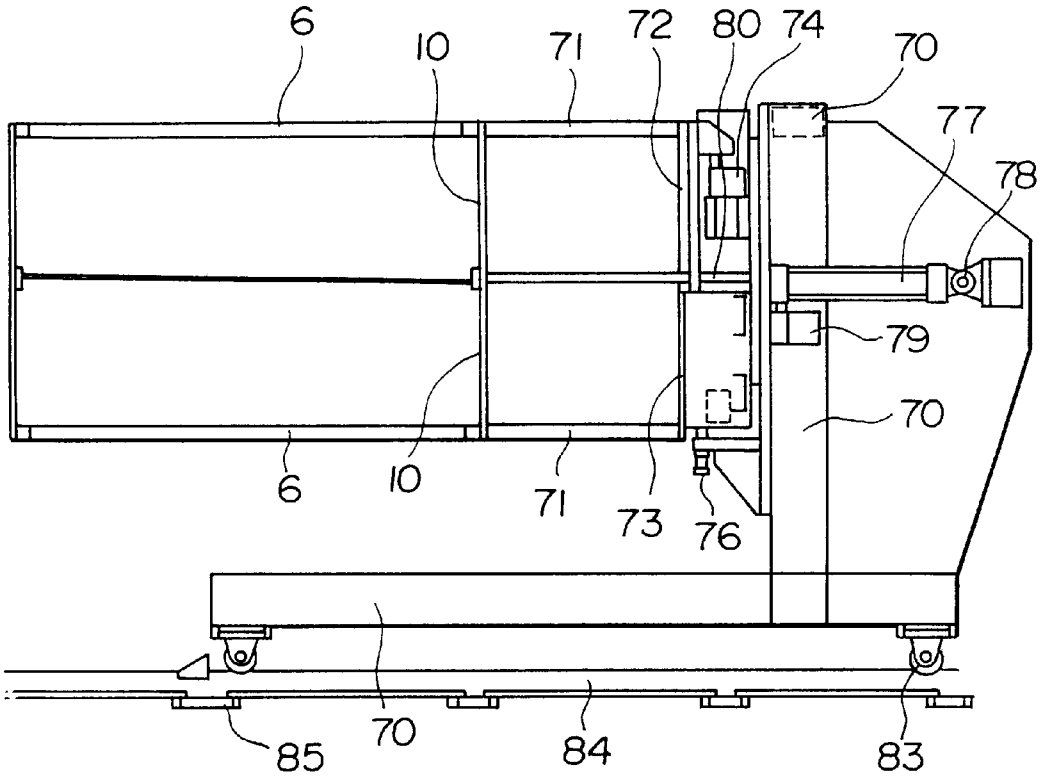
FIG. 13A is a side view showing an example of the removal device for the tapered suction roll sleeve in accordance with the present invention.

An example of an apparatus for the completely automated exchange of tapered suction roll sleeves 6 and backing wire 8 and face wire 9 is shown in FIGS. 12 and 13A, 13B. Prior to the installation of the apparatus, for example, two rails 84 are installed perpendicular to the sole plate of the former itself by means of a rail sole plate 85, in accordance with the axial line of the tapered suction roll sleeved 6 which is the object, and on these rails, a traveling cart 70 having wheels 83 is installed in a freely movable manner by means of a drive source which is not depicted. Semicircular shaped or three upper and three lower support frames 71 are provided in cart 70, and at the lead ends thereof, cross frame upper halves 72 and lower halves 73 are provided so as to be independently upwardly and downwardly moveable, and separating operating side frame 20 and operating side rotational axle 3, in a freely engageable manner with rings 10 of sleeve 6. The cross frame upper halves 72 and lower halves 73 are driven by, respectively, the hydraulic unit 74 installed thereabove and the slide frame 75. A stopper 76 is provided at the lower end of the slide frame 75, and fine adjustments of the cross frame lower halves 73 are possible by means of upward and downward motions of the upper half thereof. That is to say, by raising hydraulic unit 74, the cross frame upper halves 72 is raised, and the appropriate amount of tensile force is applied to the wire, and when the wire is withdrawn, the hydraulic unit 74 is lowered, the cross frame upper halves 72 is lowered, and stopper 76 is raised, so that cross frame lower halves 73 is raised.

A hydraulic unit connection joint 81 is provided at operating side rotational axle 3, and a sleeve drive hydraulic unit 77 is provided at the operating side of traveling cart 70 in the extended axial line of the tapered suction roll sleeve 6 via a bracket 78. A knuckle joint 80 is connected to the lead end of the sleeve drive hydraulic unit 77, and the vertical position thereof may be finely adjusted by means of a hydraulic unit raising and lowering bracket 79. The operating side rotational axle 3 in the operating side frame 20 may be connected via an affixing axle 82, and the rotation of the cylinder mold may thus be stopped during the wire exchange operation. On the other hand, in the automatic exchange device which operates with respect to unitary tapered suction roll sleeves 6, the cross frame need not be divided into upper and lower parts, and the hydraulic unit 74 and the affixing axle 82 are also unnecessary.

During exchange, the rotation of the cylinder mold is halted, and after the couch roll 43 has been raised, after the slide affixing bolts have been loosened, the frame horizontal motion units 26 and 27 are driven, the frames 20 and 21 separate from the stock inlet 34 side, and are moved to the wire exchange position. Next, one of the two-piece tapered suction roll sleeves 6 is moved while conducting positioning by slowly rotating a drive gear 59 so that the sleeve reaches a position above the axis of the cylinder mold, and then affixing axle 82 is connected. When dandy rolls are employed, cylinder raising and lowering units 26' and 27' (see FIG. 14) are driven at equal speeds, and are raised to the wire movement position. After this, the wire removal distance piece 22 of the operating side frame 20 is removed using a hydraulic jack or the like and a state of cantilevered support from the drive side is achieved by the cantilever frame hydraulic unit 24. Next, the tapered suction roll sleeve affixing device 28 is removed (the tapered suction roll sleeve sliding device 25 is not necessary in automatic wire exchange), and the traveling cart 70 is stopped at the connection position shown in FIG. 12.

Next, the hydraulic unit raising and lowering unit 79 is lowered, the sleeve drive hydraulic unit 77 is operated, and the knuckle joint 80 is coupled with the hydraulic connection unit 81; after this, the support frame 71 is engaged with the rings 10, the sleeve drive hydraulic unit 77 is operated, and the tapered suction roll sleeve 6 is withdrawn by wire. After this, the hydraulic unit raising and lowing bracket 79 is raised, the hydraulic unit connection joint 81 is isolated, and the traveling cart 70 moves in the opposite direction to the wire exchange position (standby position) shown in FIG. 13A, and after this, the hydraulic unit 74 is lowered, the upper half of the tapered suction roll sleeve 6 is lowered, and furthermore, the stopper 76 is raised, and the lower half of the tapered suction roll sleeve 6 is also raised. Then the face wire 9, and where necessary, the backing wire 8, are removed. When the wires 8 and 9 are large in size, and are manually difficult to remove, an implement similar to the traveling cart 60 described above may be prepared and the removal of wires 8 and 9 may accomplished using this.

Next, once the previously expanded face wire 9, and, where necessary, the backing wire 8, have passed the tapered suction roll sleeve 6, the stopper 76 is lowered until the lower half of the tapered suction roll sleeve 6 comes to an appropriate position, the hydraulic unit 74 is raised and the upper half of the tapered suction roll sleeve 6 is also raised, and the wire is subjected to the necessary predetermined tensile force. Next, the traveling cart 70 is stopped at the connecting position, the hydraulic unit raising and lowering bracket is lowered, the sleeve drive hydraulic unit 77 is operated, and the knuckle joint 80 is connected to the hydraulic unit connecting joint 81. After this, the sleeve drive hydraulic unit 77 is operated in reverse, and the tapered suction roll sleeve 6 is pushed in by wire. Next, the hydraulic unit raising and lowering unit 79 is raised, the knuckle joint 80 is detached from the hydraulic unit connecting joint 81, the engagement between the support frame 71 and the rings 10 is severed, and the traveling cart 70 moves in the reverse direction to the standby position.

Next, the tapered suction roll sleeve 6 is affixed to the tapered suction roll cell 5 by the tapered suction roll sleeve affixing device 28, and the wire withdrawing distance piece 22 is again inserted into frame 20, the cantilever frame hydraulic unit 24 is operated, the entire frame is again affixed, the affixing axle 82 is released, and the exchange of the wires is completed. After this, the frame horizontal movement units 26 and 27 are operated, the couch roll 34 is lowered, and preparations for formation are initiated.

Each operation described above may be automated by means of sequence control or the like. Furthermore, in the case of the exchange of tapered suction roll sleeves 6 having differing outer diameters or structures, after exchanging the old and new sleeves 6 using a crane or the like, the traveling cart 70 may be advanced from the standby position and the support frame 71 and the rings 10 may be engaged, and the subsequent operation conducted.

When the tapered suction roll sleeve sliding device 25 is not employed, as the tapered suction roll sleeve affixing device 28, in place of the drive side tapered suction roll sleeve sliding device 25, an affixing ring having a screw groove on the inner part thereof, and having an outer diameter approximating the outer diameter of the tapered suction roll sleeve 6 is inserted, and from the drive side, a plurality of affixing bolts are inserted so as to be connected with the plurality of screw holes in the rings 10 shown in FIGS. 3A, 3B, 4A, 4B, 7A, 7B and 8A, 8B and affixing is conducted.

On the other hand, in the state in which the face wire 9 which has been used and removed is supported on the sleeve, this is subjected to ultrasonic cleaning while rotating at low speed in a vat filled with a cleaning solution comprising a caustic soda liquid or the like, or is subjected to high pressure shower cleaning, and after drying in hot air, this is then folded, and placed in a case comprising a plastic cylinder or the like for storage. Backing wire 8 is cleaned in a similar manner, and when the deposits of filler or the like are extreme, these are removed by perforation using automatic brushing or an automatic multiple spindle drill, and storage is then conducted in a rack storeroom or the like.

As described above, the number of types of face wire 9 can reach several hundred in correspondence with the designs; however, the face wires are thin, and once they are removed from the tapered suction roll sleeve 6, they may be folded, and do not require much storage space, while on the other hand, the backing wire 8 is thick and difficult to fold, so that by using a common size of backing wire 8 with respect to the fixed sizes of the face wire 9, the number of varieties of this wire can be limited, and this is desirable.

Furthermore, on the drive side, the drive side frame 21, which has in the interior thereof an opening having a large aperture for the purposes of drainage, is connected to the drainage side of the central drainage pipe 2, while a low pressure suction head 55 and a high pressure suction head 56 are connected to the suction side thereof.

A cantilever frame 23, which serves to provide support in a cantilevered state during the removal of the distance piece 22 for withdrawing the wire during the exchange of wire types in operational side frame 20, is provided at the lower end of the drive side frame 21, and by means of the cantilevered frame hydraulic unit 24 which is positioned above this, the structure is capable of cantilevering the upper structure, including the central drainage pipe 2, from beneath.

On the other hand, when the wire type or the tapered suction roll sleeve 6 is exchanged, it is necessary to remove the cylinder main body or the tapered suction roll 5 from the stock inlet side, and thus to produce space for the switching of the wire or the tapered suction roll sleeve 6. In order to provide for this in such cases, at the drive side, the drive side frame 21 is divided into upper and lower parts, a drive side frame horizontal movement unit 27 containing a slide bearing is positioned in the central part, while at the operational side, the operational side frame 20 is divided into upper and lower parts, and an operational side frame horizontal movement unit 26 containing a slide bearing is provided in the central part thereof. Additionally, the units 26 and 27 on both end sides are made so as to be capable of horizontal motion (in the left and right directions in FIG. 2) at identical speeds (for example, by connecting drive axles via an intermediate axle).

Furthermore, in the central upward outer peripheral surface of the central drainage pipe 2, openings are provided, parallel to the axis of the tapered suction roll cell 5, which divide the outer peripheral surface into a number of sections in the axial cross-sectional directions, and at the peripheral parts of these openings, a plurality of suction deckles 29 are formed at positions corresponding to the paper web forming part of the cylinder which is subjected to an inflow of pulp suspension, and this is then used as a cylinder suction former. As an example thereof, in FIG. 2, in the axial periphery of the central drainage pipe 2, microsuction (or gravity dehydration) belt openings ($H_1$) are provided within a range of from −10 to +45° from the left hand side, and above this, low pressure or high pressure suction belt openings ($H_2$) are provided within a range of from approximately 40–60°, and high pressure suction or atmospheric belt openings ($H_3$) are provided within a range of approximately 20–30° from the topmost part, each respectively being arranged in directions parallel to and crossing the axis, at suction deckles 29, and each dividing part is caused to come into contact with the inner peripheral surface of the tapered suction roll cell 5. After the high pressure suction or atmospheric belt openings, air pressurization openings may be provided to assist in the high speed pick-up of fine patterns for watermarks; these correspond to the parts in contact with the couch roll 43 (that is to say, the forming part of sheet 33).

In an example of use as a cylinder suction former, the interior of the drive side frame 21 and the central drainage pipe 2 are divided by drainage pipe partition 30 and drainage pipe partition 31 in correspondence with the 3 dehydration bands described above (the four bands, where air pressurization openings were provided), and these are brought into contact with, respectively, the gravity or microsuction hole 32 and the low pressure suction hole 57 and the high pressure suction or atmospheric hole 58. The waste water remaining within the tapered suction roll after the forced suction band is removed from the outer circumference of the cylinder by centrifugal force.

In another example of use as a cylinder suction former, a low pressure suction head 55 and a high pressure suction head 56 which are provided at the outer circumferencial part on the drainage side of central drainage pipe 2 are structured so as to communicate with the low pressure suction band and high pressure suction band described above, respectively (when the air pressurization openings are provided, these may be caused to communicate with an air pressurization head which is provided).

Figure 14:
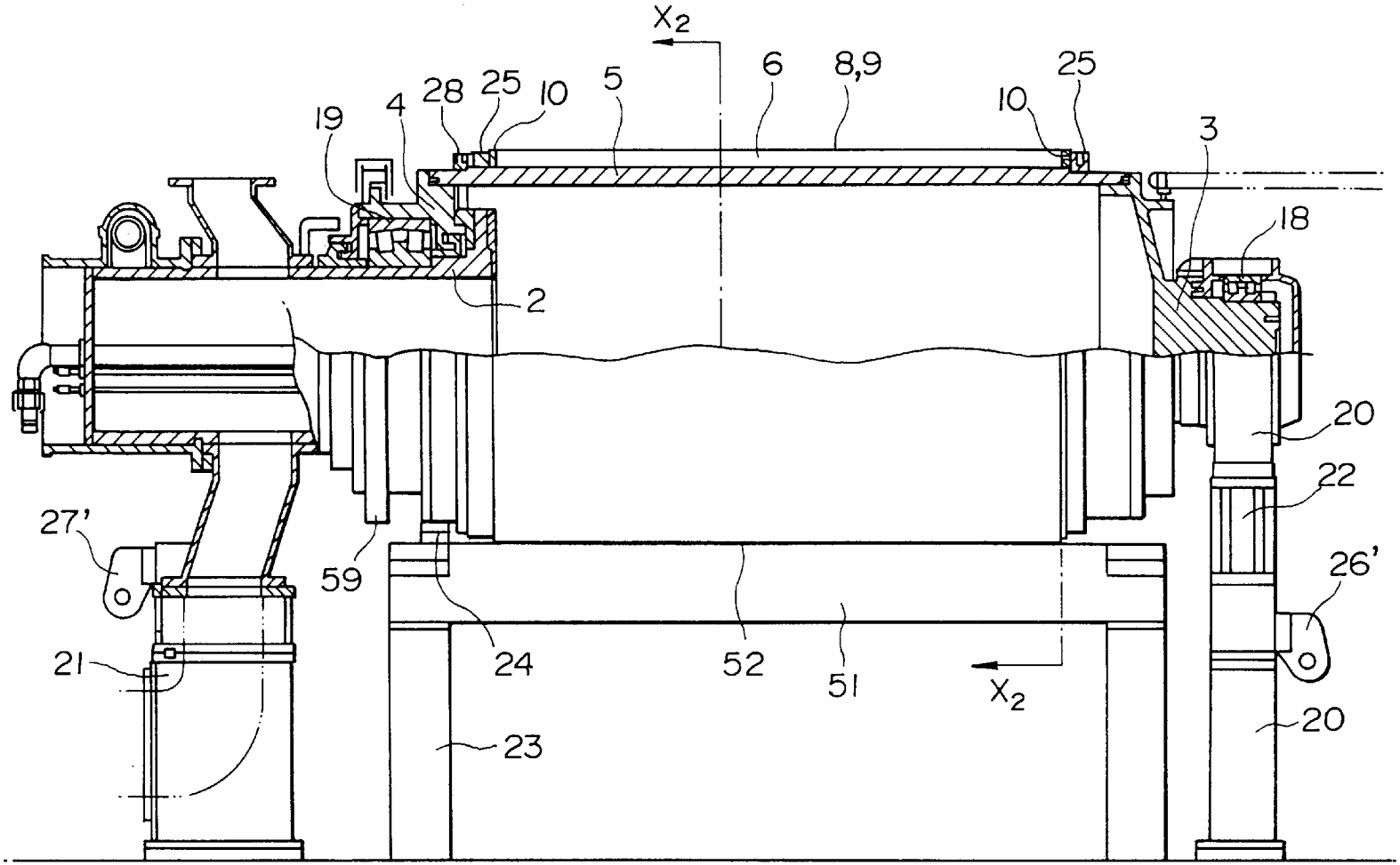
FIG. 14 is a side view and a partial vertical cross-sectional view of a paper web manufacturing device in accordance with the present invention
Figure 15:
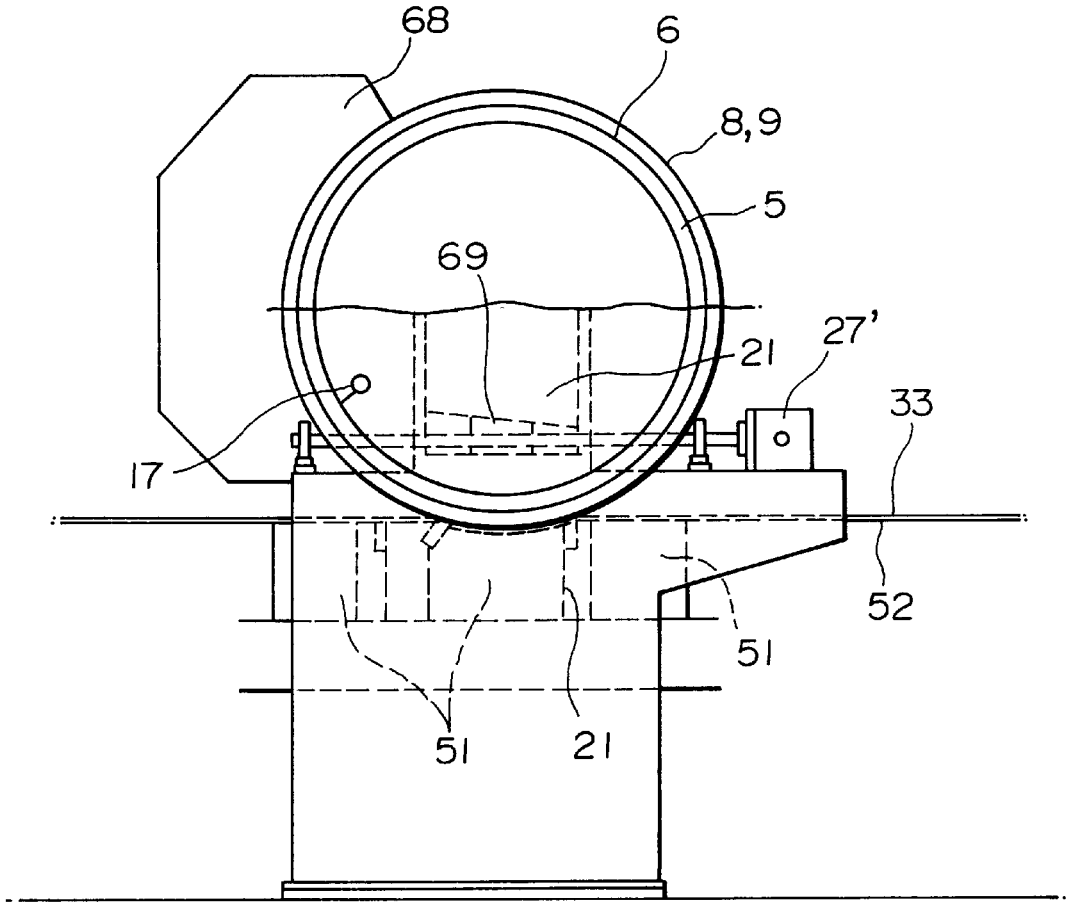
FIG. 15 is a cross-sectional view taken along the line $X_2$—$X_2$ in FIG. 14 of a paper web device in accordance with the present invention.
Figure 16:
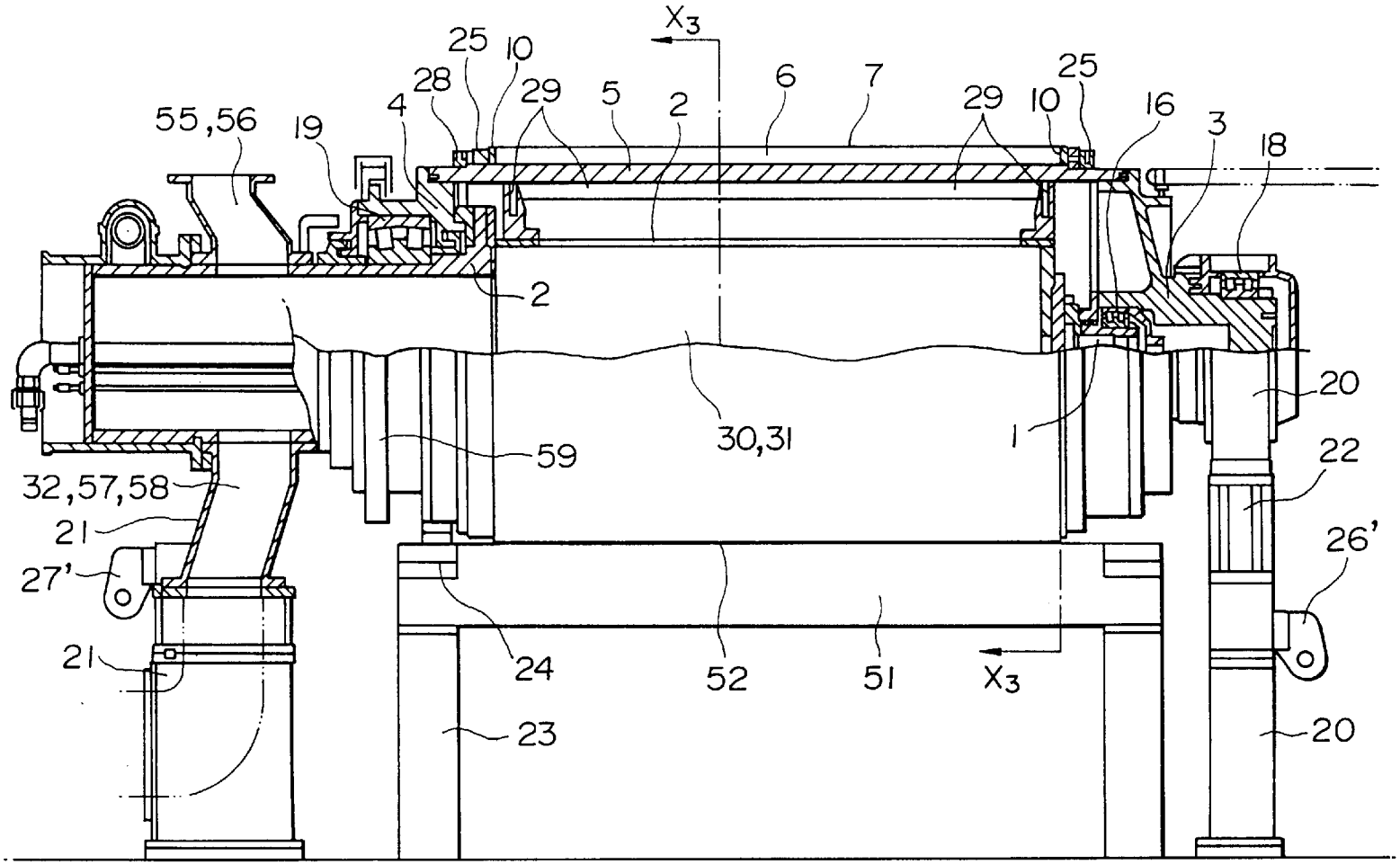
FIG. 16 is a side view and a partial vertical cross-sectional view of a paper web manufacturing device in accordance with the present invention.

Furthermore, as shown for example in FIGS. 14 through 17, the tapered suction roll 5 and the tapered suction roll sleeve 6 may be installed on the paper web forming part of a fourdrinier. FIGS. 14 and 15 show an example of a case in which this is applied to a dandy roll. In these examples, the tapered suction roll sleeve 6 is provided on a fourdrinier cylinder 52 on a suction box 51, so that the lower end surface thereof is in contact with top of the paper web forming part.

In these examples, in order to regulate the space between the paper web 33 formed on the fourdrinier wire 52 and the cylinder mold, the operational side frame 20 and the drive side frame 21 are divided into upper and lower parts, cylinder mold raising and lowering units 26' and 27' which are coupled with a cylinder mold raising and lowering tapered slider 69 which is provided with an internal slide bearing are provided in the central part thereof (for example, connected to the drive axle via an intermediate axle, or the like), and by operating the units 26' and 27' on both end sides at equal speeds, the raising and lowering of the cylinder mold may be accomplished.

Furthermore, in these examples, openings are provided in the outer peripheral surface of the central drainage pipe 2 in the center thereof and facing upward, which openings are provided parallel to the axis of the tapered suction roll cell 5 and divide the outer peripheral surface into a plurality of sections in the axial cross-sectional direction, and at the peripheries of these openings, a plurality of suction deckles 29 are formed at positions corresponding to the paper web forming part of the cylinder mold into which the pulp suspension flows, and this is used as a cylinder suction former. As an example thereof, in FIG. 17, at the axial periphery of central drainage pipe 2, micro suction dehydration (or gravity dehydration) band openings ($H_4$) are provided within a range of from approximately −10 to +45° from the left hand side, and above this, from approximately 40–60°, low pressure or high pressure suction dehydration band openings ($H_5$) are provided, and thereafter, within a range of approximately 20–30° from the top part, high pressure suction or atmospheric band openings ($H_6$) are provided in directions parallel to or perpendicular to the axis, respectively, with suction deckles 29, and each dividing part is in contact with the inner peripheral surface of the tapered suction roll cell 5. Air pressure openings may be provided after the high pressure suction or atmospheric band openings in correspondence with the combining part with the fourdrinier wire 52 (that is to say, the forming part of sheet 33), in order to facilitate the pickup of the fine pattern used for the watermark at high speed.

Figure 17:
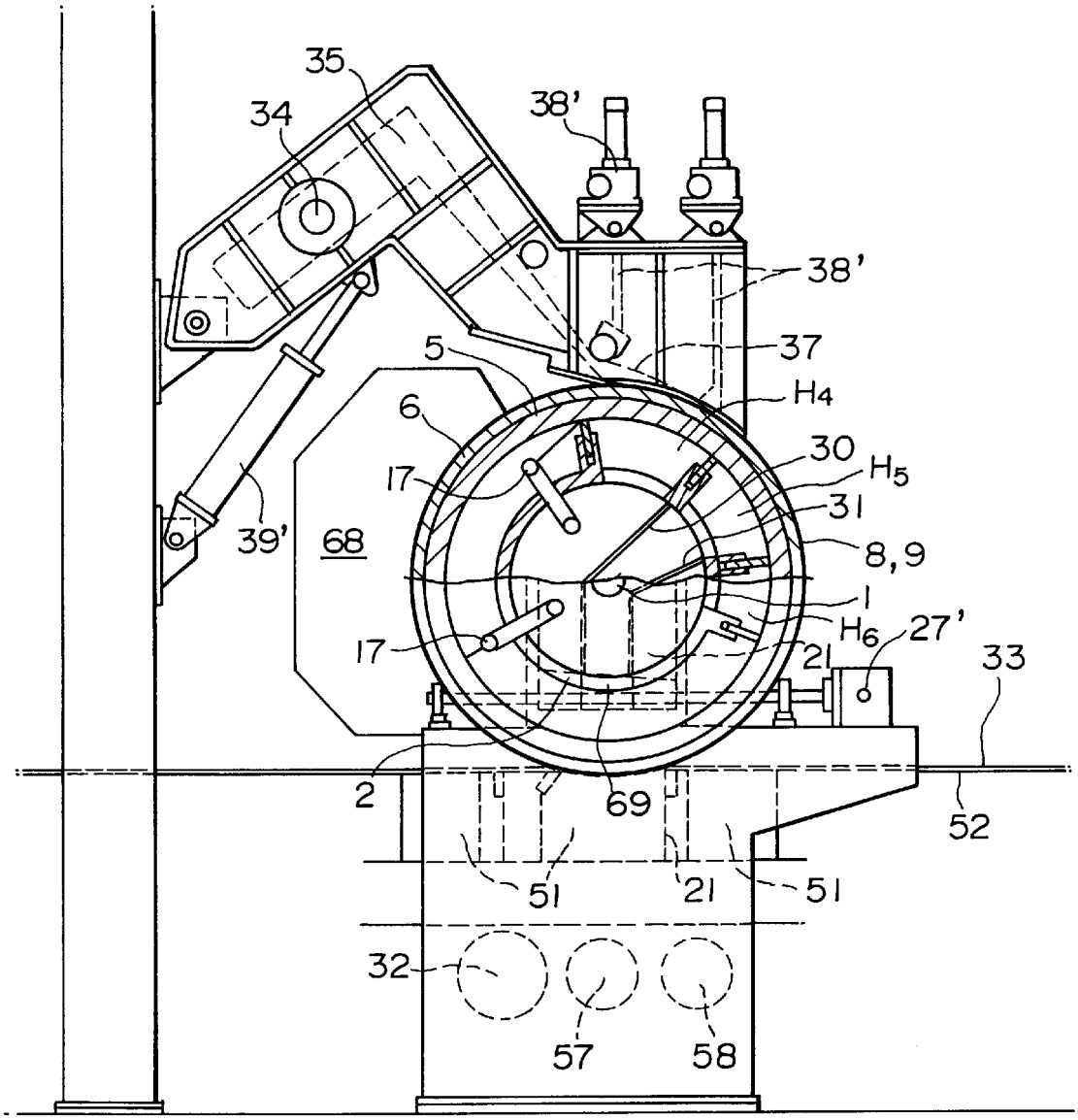
FIG. 17 is a cross-sectional view taken along the line $X_3$—$X_3$ in FIG. 16 of a paper web manufacturing device in accordance with the present invention.

Additionally, in the examples shown in FIGS. 15 and 17, waste water discharged from the outer circumference of the cylinder mold by centrifugal force is received by a catch pan 68 which prevents a disordering of the paper web 33 by the wasted water on the fourdrinier wire 52. Furthermore, in the example shown in FIG. 17, the pulp supply parts from the stock inlet 34 to the covering roof 37 are provided above the cylinder mold, and these are moved upward and downward by raising and lowering unit 38' and sidetrack unit 39'. The other structures and their functions are fundamentally identical to those given in the example shown in FIGS. 1 and 2.

Various methods exist for supplying the pulp suspension to the cylinder mold; here, as an example thereof, the water pressure head box method employing a tapered header inlet which is depicted in FIG. 2 will be explained. The pulp suspension passes through an approach line which is not depicted in the figure, is supplied to a flow box 36 via a step diffuser 35 from the stock inlet 34 by means of a pump, and is supplied at a freely determined water pressure (for example, within a range of 200–2000 mmAq) in a range from an approximately horizontal position to approximately 90° (approximately 120° in the case of installation on a paper web forming part of a fourdrinier), as an example, as described above, at a position corresponding to the paper web forming part of the cylinder mold, by covering roof 37. The paper stock which overflows from the top of the covering roof 37 returns to the approach line from an overflow hole 38 via an overflow outlet 39. The position of the covering roof 37 is set by adjusting the position of the raising and lowering unit 38' in accordance with the necessary t/y ratio of the paper web 33.

In an example in which only backing wire 8 is installed on the cylinder mold, and an endless suction breast roll, or a short wire former with suction cylinder 54 circulates at the outer circumference thereof, a wire turning roll 40 is provided essentially horizontally with the top part of the cylinder mold, and a wire roll 41 is provided together with a stretching device and a wire guide device which are not depicted in the figure, and the suction breast roll or the short wire former with suction cylinder 54 circulates synchronously with the cylinder mold.

Figure 18:
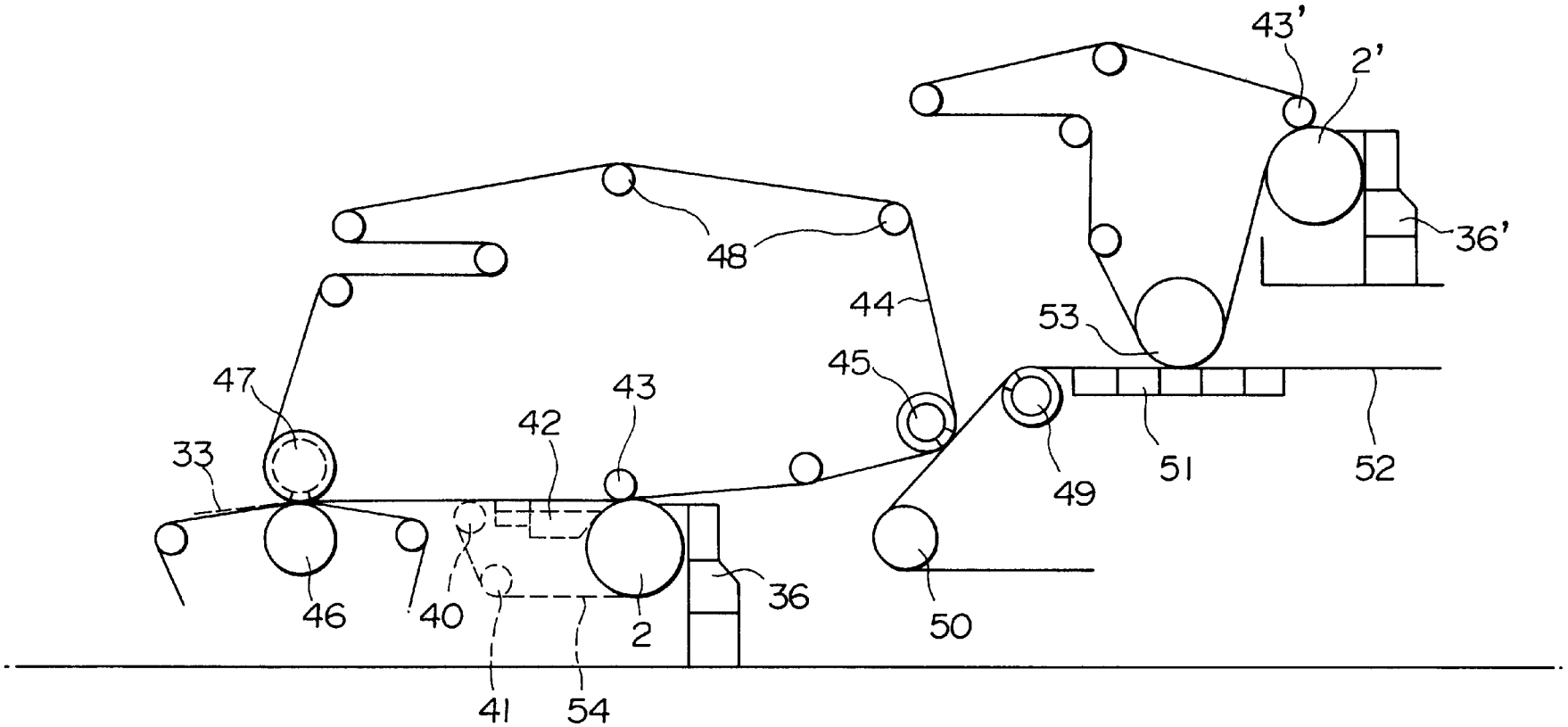
FIG. 18 is a side view showing an example of a three layer combination method embodying the method of the present invention.

Furthermore, as shown in FIG. 18, in the case of a method involving a circular-elongated-circular three-layer combination, at the upper part of the cylinder mold, the pickup felt 44 is rotated by a stretching device or felt cleaning unit, not depicted in the figure, or by a felt guide device or a plurality of felt rolls 48. Then, the circular-elongated two-layer combined sheet 33 is picked up by the suction pickup roll 45 from the fourdrinier part at the pickup felt 44, and the sheet on the cylinder mold is combined by couch roll (if possible, a suction couch roll) 43 installed on the cylinder mold.

Figure 19:
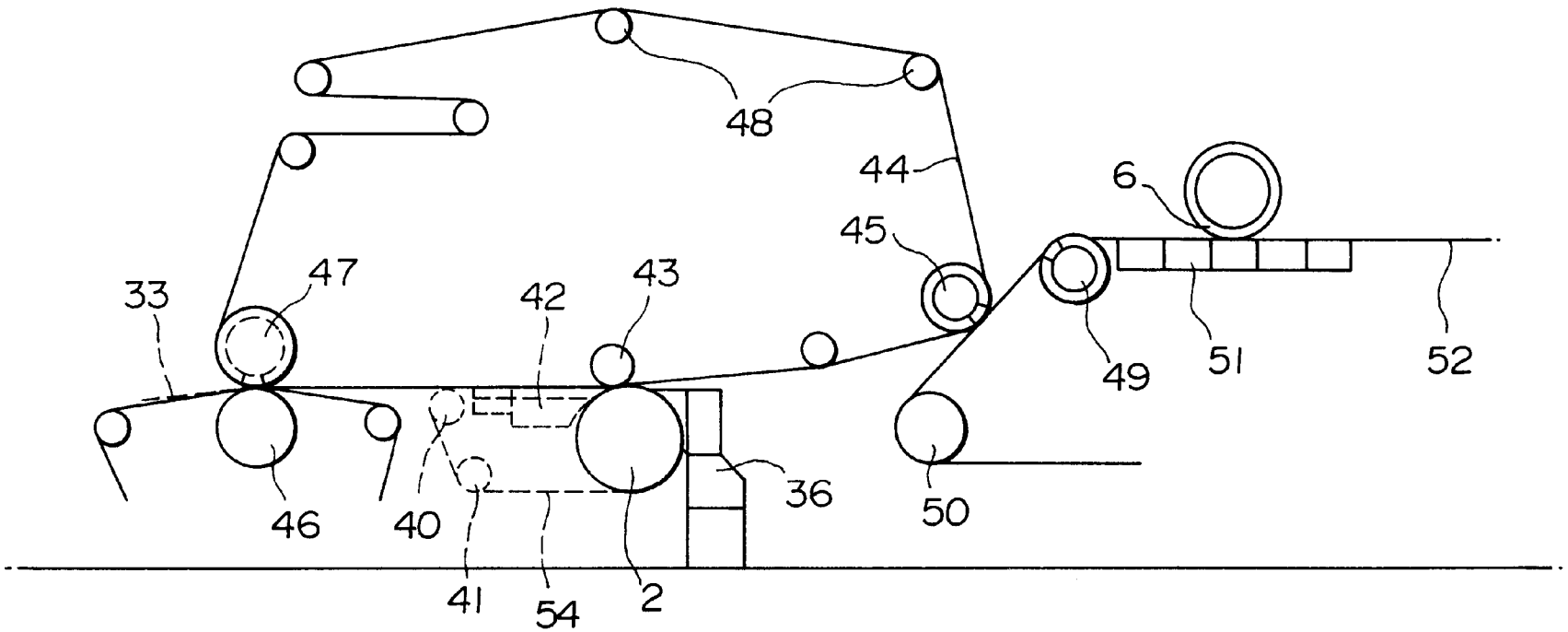
FIG. 19 is a side view showing an example of a three layer combination method embodying the method of the present invention.

As shown in FIG. 19, as an example of positioning a rotating cylinder mold on a suction box 51 of a fourdrinier and placing a watermark on a paper web 33 on the fourdrinier wire 52 and then supplying a completely different pulp and conducting a combination with a new paper web, even in the case of a longitudinal-circular-circular three-layer combination method, the pickup felt 44 is circulated by a stretching device or a felt cleaning unit, not depicted in the figure, a felt guide device, or a plurality of felt rolls 48. Then, at the pickup felt 44, the longitudinal-circular two-layer combination sheet 33 is picked up by the suction pickup roll 45 from the fourdrinier part, and the sheet on the cylinder mold is combined by a couch roll (preferably a suction couch roll) 43 installed on the cylinder mold.

On the other hand, in the case of the manufacture of extremely thin paper which is not watermarked, rapid paper web formation may involve the generation of pinholes or the like, so that as shown by the dotted line in FIG. 18, the face and backing wires 8 and 9 of the cylinder mold may be removed, or only face wire 9 may be removed and backing wire 8 installed, and while maintaining contact with the pickup felt 44 which travels approximately horizontally with the top part of the cylinder mold, a suction breast roll or a short wire former with suction cylinder 54 may be circulated, and combination may be carried out while slowly forming a paper web using the arc forming board 42 of a multiblade.

When combining has been completed, the sheet 33 is dehydrated by means of a first press bottom roll 46 and a top roll 47, and proceeds to the next process.

The driving of the cylinder mold may be a single drive by means of, for example, a cylinder drive gear 59, or may involve inverted rotation resulting from the contact between the rotating felt 44 and the couch roll 43, and furthermore, at the suction breast roll or the short wire former with suction cylinder, the short wire former with suction cylinder 54 may be driven by the wire turning roll 40.

Furthermore, a fourdrinier wire 52 having placed thereon paper stock supplied from the stock inlet of the fourdrinier is circulated by wire turning roll 50 from suction couch roll 49 via suction box 51; however, as an example, as shown by reference nos. 2', 36', and 43' in FIG. 18, here, on-top type cylinder molds, suction breast rolls or short wire formers with suction cylinders which are similar to those described above may be provided, and combining may be conducted by touch roll 53 on suction box 51.

Furthermore, in each of the examples described above, the cylinder mold which is used as the dandy roll, is capable of freely taking out and putting in the outer circumference of the tapered suction roll sleeve 6 is preferably rotated at a circumferencial speed which is either approximately the same as that of the fourdrinier wire or within a range of plus or minus 6% thereof.

Finally, with respect to the effects of the present invention, a comparison will be made with respect to the conventional technology.

Conventionally, with respect to the method for supplying the pulp suspension to the cylinder mold, the cylinder mold was installed within the cylinder vat, the pulp suspension was supplied from one end of the vat, and recovered from the other end of the vat, or a semi-dry vat method was employed in which recovery was conducted from the center; in both methods, in order to exchange the cylinder mold as described above, it is necessary to remove in advance not only the couch rolls, the felt, and the shower implements, but also the various watermarking implements, and the cylinder mold, which has considerable weight, must be lifted from, the vat by means of a crane or the like, and the next cylinder mold, which was prepared in advance, must be placed therein, and all of the various equipment must be reassembled, so that this requires an enormous amount of labor, and three to four hours of stoppage time.

Furthermore, it is impossible to remove the watermark wire which is seam-welded to the cylinder mold, and when this becomes filled with filler together with the backing wire, and the watermark becomes indistinct, a high-cost watermark wire must be discarded. In order to avoid this, a method is employed in which after the wire is removed and washed, it is resewn; however, this method also involves a period of several days.

On the other hand, even among common papers which are not watermarked, there are products for special use in which are combined, in addition to the wood pulp, large amounts of natural elongated fibers such as Manila hemp fibers or ambari hemp fibers, synthetic fibers such as rayon, aramide, polyester, or nylon, inorganic fibers such as glass, slag, or cement or the like, metallic fibers such as stainless steel or the like, or powders such as calcium carbonate or aluminum hydroxide or the like; it is accordingly necessary to change the type of face wire each time to a special face wire such as a mat or lace, or those having various weaving types or meshes. Accordingly, this requires a large amount of labor and a stoppage time reaching 3 to 4 hours.

Furthermore, in conventional suction cylinder molds, the thickness in the solid suction roll structure was 50–60 mm or more, and the interior thereof also had a complicated suction seal structure, so that it was completely impossible to change the diameter, and thus it was totally impossible to use such cylinder molds for watermarked paper.

In contrast, in the examples employing the present invention to the cylinder former or the dandy roll installed on the paper web forming part of the fourdrinier, the exchange of the wire is achieved by removing the cylinder mold from stock inlet, removing the distance piece from the operating side, withdrawing the tapered suction roll sleeve with wire, and insert another tapered suction roll sleeve with new wire. And therefore, within approximately 10 minutes, an exchange can be completed with another tapered suction roll sleeve which has been cleaned. As a result, it is possible to greatly improve the production efficiency and to greatly reduce the costs, and the production of small lots is facilitated; in addition, the quality of the paper is stable, and this makes it possible to respond to the needs of a large number of customers. Furthermore, in the other examples in accordance with the present invention, using the methods involving extendible and retractable (variable-diameter) cylinder suction formers, it is possible to produce watermarked paper at high speed.

On the other hand, there are a number of examples of use as suction rolls, such as suction couch rolls, suction pickup rolls, or suction press rolls or the like for various types of formers; however, in all of these, the fine fibers present in the paper stock or the viscous materials such as resin or the like, or various types of fillers, pass through the wire and are drawn into the holes of the suction roll, these are deposited in the wire or in the holes, and the amount of water passing through the suction roll dramatically declines. Accordingly, the moisture content of the paper web gradually increases, and this leads to the occurrence of moisture irregularities in the width direction of the paper, and in particular, when the removal of water at the suction pickup roll worsens, severance of the paper occurs, and this produces enormous losses (involving the processing of an enormous amount of lost paper at stoppages and restarts, the loss of electrical or steam energy, losses resulting from the dramatic decline in the amount produced, the increase in the workload of the operating personnel and the attendant increase in the number of personnel, and the like). Furthermore, as the amount of water discharged at the suction press roll declines, costs involved with the amount of water vapor increase dramatically as a result of severing of the paper, moisture irregularities in the width direction, and dried parts, so that the physical properties of the paper (the smoothness, density, strength, the degree of water-induced stretching, the curl, and the like) worsen.

Accordingly, when the number of holes which are blocked increases, it is necessary to temporarily stop the former, to remove the endless wire, to dismantle the suction roll, to remove the suction roll cell, and then to free a large number of suction holes one by one using a manual drill. As a result of mistakes by the operator, there are cases in which the suction deckles or other parts are damaged by the manual drill.

In contrast, in the other examples employing the present invention to the suction roll, the wire stretch roll or the suction roll can be moved to free the endless wire, the distance piece on the operational side frame can be removed, the tapered suction roll sleeve can be withdrawn, preferably in the axial direction to the operational side, and within approximately 10 minutes, an exchange can be completed with another tapered suction roll sleeve which has been cleaned. As a result, it is possible to greatly improve the production efficiency and to greatly reduce the costs, and the production of small lots is facilitated; in addition, the quality of the paper is stable, and this makes it possible to respond to the needs of a large number of customers.

What is claimed is:

1. A paper web manufacturing method employing detachable roll in which a cylinder mold which is provided with a tapered roll cell, the outer peripheral surface of which is inclined, preferably toward the operational side in the axial direction, in a rotatable manner, and in which a cylindrical tapered roll sleeve, the inner peripheral surface of which has the same inclination as the outer circumference of the tapered roll cell, can be attached and detached, preferably from the operational side, thus making the sleeve outer circumference freely withdrawable and insertable, is placed on a paper web formation part of a fourdrinier, and is rotated at a circumferencial speed which is either approximately equal to that of the fourdrinier wire or within plus or minus 6% thereof.

2. A paper web manufacturing method employing a detachable roll, wherein a cylinder mold which is provided with: a tapered roll cell having an outer peripheral surface which is inclined, preferably toward the operational side in the axial direction, in a rotatable manner; and a cylindrical tapered roll sleeve which is freely extendible in the inward and outward circumferencial directions and has an inner peripheral surface having an inclination identical to that of the outer circumference of the tapered roll cell, and which is attached and detached, preferably from the operational side, and thereby, the outer circumference of the sleeve is made freely withdrawable and insertable; is placed on the paper web forming part of a fourdrinier, and is rotated at a speed which is either approximately equal to that of the fourdrinier wire or is within a range of plus or minus 6% thereof.

3. A paper web manufacturing method employing a detachable suction cylinder or suction roll, wherein a hollow shaft having openings divided along the outer circumference thereof is provided in a non-rotating manner, and at the outer circumference thereof, a tapered suction roll cell, the outer peripheral surface of which is inclined, preferably toward the operational side in the axial direction, is provided in a rotatable manner about the hollow shaft, and a cylindrical tapered suction roll sleeve having an inner peripheral surface having an inclination identical to that of the outer circumference of the tapered suction roll cell is attached and detached, preferably from the operational side.

4. A paper web manufacturing method employing a detachable suction cylinder or suction roll, wherein a hollow shaft having openings divided along the outer circumference thereof is provided in a non-rotating manner, and at the outer circumference thereof, a tapered suction roll cell having an outer peripheral surface which is inclined, preferably toward the operational side in the axial direction, is provided in a rotatable manner about the hollow shaft, and a cylindrical tapered suction roll sleeve having an inner peripheral surface having the same inclination as the outer circumference of the tapered suction roll cell is attached and detached, preferably from the operational side, and thereby, the sleeve is made freely withdrawable and insertable, and paper stock is further supplied from the outer circumferencial side and a paper web is formed.

5. A paper web manufacturing method employing a detachable suction cylinder or suction roll, wherein: a hollow shaft is provided in a non-rotating manner which has openings for suction which are divided into two or more parts by the suction system along the outer circumference, and which is connected with discharge holes to the exterior and with a vacuum source; a tapered suction roll cell, the inner circumference of which is divided by the openings in the hollow shaft and suction deckles and communicates therewith, and which has an outer peripheral surface which is inclined, preferably toward the operational side in the axial direction, is provided about the hollow shaft in a rotatable manner; and a cylindrical tapered suction roll sleeve having an inner peripheral surface having a inclination equal to that of the outer circumference of the tapered suction roll cell is attached and detached, preferably from the operational side.

6. A paper web manufacturing method employing a detachable suction cylinder or suction roll, wherein a hollow shaft having openings divided along the outer circumference thereof is provided in a non-rotating manner, and at the outer circumference thereof, a tapered suction roll cell having an outer peripheral surface which is inclined, preferably toward the operational side in the axial direction, is provided in a rotatable manner about the hollow shaft, and a cylindrical tapered suction roll sleeve which is freely expandable and contractible in the inward and outward circumferencial directions and has an inner peripheral surface having an inclination identical to that of the outer circumference of the tapered suction roll cell is attached and detached, preferably from the operational side, and thereby, the resulting rotating cylinder mold for forming is made freely withdrawable and insertable, and paper stock is supplied thereto from the outer circumferencial side, and a paper web is formed.

7. A paper web manufacturing method employing a detachable suction cylinder or suction roll, wherein a hollow shaft is provided in a non-rotating manner, which has openings for suction which are divided into two or more parts by the suction system along the outer circumference, and which is connected with discharge holes to the exterior and with a vacuum source, and at the outer circumference thereof, a tapered suction roll cell, the inner circumference of which is divided by suction deckles and communicates with the openings in the hollow shaft, and which has an outer peripheral surface which is inclined, preferably toward the operational side in the axial direction, is provided in a rotatable manner about the hollow shaft, and a cylindrical tapered suction roll sleeve having an inner peripheral surface with an inclination identical to that of the outer circumference of the tapered suction roll cell is attached and detached, preferably from the operational side, and thereby, the sleeve is made freely withdrawable and insertable, paper stock is supplied from the outer circumferencial side, and a paper web is formed.

8. A paper web manufacturing method employing a detachable suction cylinder or suction roll, wherein a hollow shaft is provided in a non-rotating manner, which has openings for suction which are divided into two or more parts by the suction system along the outer circumference, and which is connected with discharge holes to the exterior and with a vacuum source, and at the outer periphery thereof, a tapered suction roll cell, the inner periphery of which is divided by suction deckles and communicates with the openings in the hollow shaft, and which has an outer peripheral surface which is inclined, preferably toward the operational side in the axial direction, is provided in a rotatable manner about the hollow shaft, and a cylindrical tapered suction roll sleeve having an inner peripheral surface with an inclination equal to that of the outer circumference of the tapered suction roll cell can be attached and detached, preferably from the operational side, a wire turning roll, a wire roll, and a wire stretch and guide apparatus is provided, a suction breast roll or short wire former with suction cylinder is installed and these are made to circulate, and paper stock is supplied to the outer circumferencial side of the suction wire to form a paper web.

9. A paper web manufacturing method employing a detachable suction cylinder or suction roll, wherein one end is either directly affixed to an operational side frame as a central fixed axle, or is affixed via an operational side drainage pipe rotational bearing, while the other end is affixed to a drive side frame as a central drainage pipe having a plurality of drainage openings in the central outer peripheral part thereof, and at the outer periphery thereof, a tapered suction roll cell, the outer peripheral surface of which is inclined, preferably toward the operational side in the axial direction, is affixed on an operational side frame at the operational side via an operational side rotational axle and an operational side rotational axle bearing, and on a drive side frame via a drive side rotational axle and a drive side rotational axle bearing, and a cylindrical tapered suction roll sleeve having an inner peripheral surface having an inclination equal to that of the outer circumference of the tapered suction roll cell is installed so as to be freely detachable and attachable, preferably from the operational side.

10. A paper web manufacturing method employing a detachable suction cylinder or suction roll in accordance with claim 9, wherein a plurality of rings, having identical outer diameters and the inner circumferences of which decrease in a stepwise fashion and which have an approximately circular form are affixed at equal spacings by axial direction reinforcing ribs, wire is wound around the outer circumferences thereof, thereby forming a perforated cylinder with an inner circumferencial taper having the required width and diameter, and this cylinder can be detached and attached to the tapered suction roll cell via screw nuts or hydraulic withdraw and insert means or the like as the tapered suction roll sleeve.

11. A paper web manufacturing method employing a suction cylinder or suction roll in accordance with claim 9, wherein a plurality of rings, having identical outer diameters and the inner circumferences of which decrease in a stepwise fashion and are approximately circular are affixed, together with axial direction reinforcing ribs, at approximately equal spacings to an inner peripheral surface of a cylinder perforated shell having a plurality of holes, thus forming a perforated cylinder with an inner cylindrical taper which has the required width and diameter, and this cylinder can be attached to and detached from the tapered suction roll cell by means of screw nuts or hydraulic withdraw and insert means as the tapered suction roll sleeve.

12. A paper web manufacturing method employing a suction cylinder or suction roll in accordance with claim 9, wherein a perforated cylinder with an inner circumferencial taper, has a plurality of holes in the outer peripheral surface thereof, and preferably has void grooves in the inner peripheral surface thereof, and this cylinder can be attached to and detached from the tapered suction roll cell by means of screw nuts or hydraulic withdraw and insert means as the tapered suction roll sleeve.

13. A paper web manufacturing method employing a suction cylinder or suction roll in accordance with claim 9, wherein the inner part of the central drainage pipe is provided with drainage pipe partitions which divide the interior by the suction system, and the central outer part of the central drainage pipe is made into drainage holes which are divided by suction deckles, the rotating suction roll cell is tightly sealed, and is connected with, respectively, drainage holes to the exterior and a vacuum source.

14. A paper web manufacturing method employing a suction cylinder or suction roll in accordance with claim 9, wherein at the outer periphery of the tapered suction roll sleeve, a suction breast roll or a short wire former with suction cylinder is circulated via a wire turning roll and a wire roll.

15. A paper web manufacturing method employing a detachable suction cylinder, wherein a hollow shaft is provided in a non-rotating manner which has openings for suction divided into two or more parts by the suction system along the outer circumference, and which is connected with drainage holes to the exterior and with a vacuum source, and at the outer periphery thereof, a tapered suction roll cell, the inner periphery of which communicates with openings in the hollow shaft, which is sealed with suction deckles, and which has an outer peripheral surface which is inclined, preferably toward the operational side in the axial direction, is provided in a rotatable manner about the hollow shaft, and a tapered suction roll sleeve which forms a cylinder having an inner peripheral surface having an inclination equal to that of the outer circumference of the tapered suction roll cell, and which is divided into two or more parts, and is made freely expandable and contractible in the inward and outward circumferencial directions by means of a connecting means, is attached and detached, preferably from the operational side, and thereby, a paper making wire which is endless and which is placed at the outer periphery of the sleeve is made freely withdrawable and insertable, and paper stock is supplied from the outer peripheral surface thereof and a paper web is formed.

16. A paper web manufacturing device employing a detachable suction cylinder, wherein a hollow shaft is provided in a non-rotating manner which has openings for suction divided into two or more parts by the suction system along the outer circumference, and which is connected with drainage holes to the exterior and with a vacuum source, and at the outer periphery thereof, a tapered suction roll cell, the inner periphery of which communicates with openings in the hollow shaft, which is sealed with suction deckles, and which has an outer peripheral surface which is inclined, preferably toward the operational side in the axial direction, is provided in a rotatable manner about the hollow shaft, and a tapered suction roll sleeve which forms a cylinder having an inner peripheral surface having an inclination equal to that of the outer circumference of the tapered suction roll cell, and which is divided into two or more parts, and is made freely expandable and contractible in the inward and outward circumferencial directions by means of a connecting means, is attached and detached, preferably from the operational side, a wire turning roll, a wire roll, and a wire stretch and guide device is provided, a short wire former with suction cylinder is installed and this is circulated, and paper stock is supplied from the outer peripheral surface of the suction wire and a paper web is formed.

17. A paper web manufacturing device employing a detachable suction cylinder, wherein a hollow shaft is provided in a non-rotating manner which has openings for suction divided into two or more parts by the suction system along the outer circumference, and which is connected with drainage holes to the exterior and with a vacuum source, and at the outer periphery thereof, a tapered suction roll cell, the inner periphery of which communicates with openings in the hollow shaft, which is sealed with suction deckles, and which has an outer peripheral surface which is inclined, preferably toward the operational side in the axial direction, is provided in a rotatable manner about the hollow shaft, and a tapered suction roll sleeve which forms a cylinder having an inner peripheral surface having an inclination equal to that of the outer circumference of the tapered suction roll cell, and which is divided into two or more parts, and is made freely expandable and contractible in the inward and outward circumferencial directions by means of a connecting means, is made freely attachable and detachable, preferably from the operational side, and a backing wire, and where necessary, a further face wire are installed at the outer peripheral surface thereof.

18. A paper web manufacturing device in accordance with claim 17, wherein, as the tapered suction roll sleeve, a plurality of two-piece rings which are approximately semicircular are affixed, together with axial direction reinforcing ribs, at approximately equal spacings to an inner peripheral surface of a cylinder perforated shell having a plurality of holes, forming a pair of semicylindrical pipes having the necessary width and diameter, and furthermore, both ends of the two-piece rings are connected in an extendible and retractable manner via affixing tapered holes and connecting pins which engage in these affixing tapered holes so that the space between both ends is expandable and contractible, and the rings form a circular shape when the space between both ends is expanded.

19. A paper web manufacturing device in accordance with claim 17, wherein, as the tapered suction roll sleeve, a unitarily molded product forming a pair of semicylindrical pipes having a plurality of holes in the outer peripheral surface thereof and preferably having void grooves in the inner peripheral surfaces thereof is employed, and furthermore, both end parts thereof are connected to one another via affixing tapered holes and connecting pins which engage in these affixing tapered holes so that the space between both ends is expandable and contractible, and the rings form a circular shape when the space between both ends is expanded.

20. A paper web manufacturing device in accordance with claim 17, wherein, at the outer circumference of the backing wire, a short wire former with suction cylinder circulates via a wire turning roll and a wire roll.

21. A paper web manufacturing device in accordance with claim 17, wherein the interior of the central drainage pipe is divided by the suction system and is provided with drainage pipe partitions, the central outer circumferencial part of the central drainage pipe is formed into discharge openings divided by suction deckles, this is tightly sealed with the rotating tapered suction roll cell, and is connected with discharge holes to the exterior and with a vacuum source.

22. A paper web manufacturing device in accordance with claim 18, wherein both ends of the rings are extended slightly in an arc shape, and both ends thereof are connected via affixing tapered holes and connecting pins which engage in these affixing tapered holes so that the space between both ends is expandable and contractible, and the rings form a circular shape when the space between both ends is expanded.

23. A paper web manufacturing method employing a detachable suction roll, wherein a hollow shaft having openings divided along the outer circumference thereof is provided in a non-rotating manner, and at the outer circumference thereof, a tapered suction roll cell having an outer peripheral surface which is inclined, preferably toward the operational side in the axial direction, is provided in a rotatable manner about the hollow shaft, and a cylindrical tapered suction roll sleeve having an inner peripheral surface having the same inclination as the outer circumference of the tapered suction roll cell is attached and detached, preferably from the operational side, and thereby, the resulting cylinder mold has a sleeve outer circumference which is made freely withdrawable and insertable, and the cylinder mold is placed on the paper web forming part of a fourdrinier, and is rotated at a speed which is either approximately equal to that of the fourdrinier wire or is within a range of plus or minus 6% thereof.

24. A paper web manufacturing method employing a detachable suction roll, wherein a hollow shaft having openings divided into two or more parts along the outer circumference thereof is provided in a non-rotating manner, and at the outer circumference thereof, a tapered suction roll cell having an outer peripheral surface which is inclined, preferably toward the operational side in the axial direction, is in sealed contact with the openings in the hollow shaft at the inner circumference thereof, and connected with drainage holes to the exterior and a vacuum source, and is provided in a rotatable manner about the hollow shaft, and a cylindrical tapered suction roll sleeve having an inner peripheral surface having an inclination identical to that of the outer circumference of the tapered suction roll cell is attached and detached, preferably from the operational side, and thereby, in the resulting cylinder mold, the outer circumference of the sleeve is made freely withdrawable and insertable, and the cylinder mold is placed on the paper web forming part of a fourdrinier, and is rotated at a speed which is either approximately equal to that of the fourdrinier wire or is within a range of plus or minus 6% thereof.

25. A paper web manufacturing method employing a detachable suction roll, wherein a hollow shaft having openings divided along the outer circumference thereof is provided in a non-rotating manner, and at the outer circumference thereof, a tapered suction roll cell, the outer peripheral surface of which is inclined, preferably toward the operational side in the axial direction, is provided in a rotatable manner about the hollow shaft, and a cylindrical tapered suction roll sleeve having an inner peripheral surface having an inclination identical to that of the outer circumference of the tapered suction roll cell is attached and detached, preferably from the operational side, and thereby, the resulting cylinder mold is made freely withdrawable and insertable, and the cylinder mold is installed on the paper web forming part of a fourdrinier, paper stock is supplied to the suction band from the outer peripheral surface of the cylinder mold and a paper web is formed, and rotation is conducted at a speed which is approximately equal to that of the fourdrinier wire.

26. A paper web manufacturing method employing a detachable suction roll, wherein a hollow shaft having openings divided along the outer circumference thereof is provided in a non-rotating manner, and at the outer circumference thereof, a tapered suction roll cell having an outer peripheral surface which is inclined, preferably toward the operational side in the axial direction, is provided in a rotatable manner about the hollow shaft, and a cylindrical tapered suction roll sleeve which is freely expandable and contractible in the inward and outward circumferencial directions and has an inner peripheral surface having an inclination identical to that of the outer circumference of the tapered suction roll cell is attached and detached, preferably from the operational side, and thereby, a variable-diameter cylinder mold in which an endless forming wire is placed at the outer circumference of the sleeve, and is made freely withdrawable and insertable, is installed on the paper web forming part of a fourdrinier, paper stock is supplied to the suction band from the outer peripheral surface of the cylinder mold and a paper web is formed, and rotation is conducted at a speed which is approximately equal to that of the fourdrinier wire.

27. A paper web manufacturing method employing a detachable suction roll, wherein a hollow shaft is provided in a non-rotating manner, which has openings for suction which are divided into two or more parts by the suction system along the outer circumference, and which is connected with discharge holes to the exterior and with a vacuum source, and at the outer circumference thereof, a tapered suction roll cell, the inner circumference of which is divided by suction deckles and communicates with the openings in the hollow shaft, and which has an outer peripheral surface which is inclined, preferably toward the operational side in the axial direction, is provided in a rotating manner about the hollow shaft, and a cylindrical tapered suction roll sleeve having an inner peripheral surface with an inclination identical to that of the outer circumference of the tapered suction roll cell is attached and detached, preferably from the operational side, and thereby, the resulting cylinder mold has a sleeve outer circumference which is made freely withdrawable and insertable, and the cylinder mold is installed on the paper web forming part of a fourdrinier, paper stock is supplied to the suction band from the outer peripheral surface of the cylinder mold and a paper web is formed, and rotation is conducted at a speed which is approximately equal to that of the fourdrinier wire.

28. A paper web manufacturing method employing a detachable suction cylinder, wherein a hollow shaft is provided in a non-rotating manner which has openings for suction divided into two or more parts by the suction system along the outer circumference, and which is connected with drainage holes to the exterior and with a vacuum source, and at the outer periphery thereof, a tapered suction roll cell, the inner periphery of which communicates with openings in the hollow shaft, which is sealed with suction deckles, and which has an outer peripheral surface which is inclined, preferably toward the operational side in the axial direction, is provided in a rotatable manner about the hollow shaft, and a tapered suction roll sleeve which forms a cylinder having an inner peripheral surface having an inclination equal to that of the outer circumference of the tapered suction roll cell, and which is divided into two or more parts, and is made freely expandable and contractible in the inward and outward circumferencial directions by means of a connecting means, is attached and detached, preferably from the operational side, and thereby, a variable-diameter cylinder mold in which an endless forming wire is placed at the outer circumference of the sleeve, and is made freely withdrawable and insertable, is installed on the paper web forming part of a fourdrinier, paper stock is supplied to the suction band from the outer peripheral surface of the cylinder mold and a paper web is formed, and rotation is conducted at a speed which is approximately equal to that of the fourdrinier wire.

29. A paper web manufacturing device employing a detachable cylinder, wherein one end is affixed on an operational side frame as an operational side rotational axle via an operational side rotational axle bearing to an operational side frame, while the other end is affixed on a drive side frame as a drive side rotational axle via a drive side rotational axle bearing, and at the outer periphery thereof, a tapered suction roll cell, the outer peripheral surface of which is inclined, preferably toward the operational side in the axial direction, is affixed, and a tapered suction roll sleeve which forms a cylinder having an inner peripheral surface having an inclination equal to that of the outer circumference of the tapered suction roll cell, is made freely attachable and detachable, and a backing wire, and where necessary, a further face wire are installed at the outer peripheral surface thereof.

30. A paper web manufacturing device employing a detachable cylinder, wherein one end is affixed on an operational side frame as an operational side rotational axle via an operational side rotational axle bearing to an operational side frame, while the other end is affixed on a drive side frame as a drive side rotational axle via a drive side rotational axle bearing, and at the outer periphery thereof, a tapered suction roll cell, the outer peripheral surface of which is inclined, preferably toward the operational side in the axial direction, is affixed, and a tapered suction roll sleeve which forms a cylinder having an inner peripheral surface having an inclination equal to that of the outer circumference of the tapered suction roll cell, and which is divided into two or more parts, and is made freely expandable and contractible in the inward and outward circumferencial directions by means of a connecting means, is attached and detached, preferably from the operational side, and a backing wire, and where necessary, a further face wire are installed at the outer peripheral surface thereof.

31. A paper web manufacturing device employing a detachable cylinder, wherein one end is either directly affixed to an operational side frame as a central fixed axle, or is affixed via an operational side drainage pipe rotational bearing, while the other end is affixed to a drive side frame as a central drainage pipe having a plurality of drainage openings in the central outer peripheral part thereof, and at the outer periphery thereof, a tapered suction roll cell, the outer peripheral surface of which is inclined, preferably toward the operational side in the axial direction, is affixed on an operational side frame at the operational side via an operational side rotational axle and an operational side rotational axle bearing, and on a drive side frame via a drive side rotational axle and a drive side rotational axle bearing, and a cylindrical tapered suction roll sleeve having an inner peripheral surface having an inclination equal to that of the outer circumference of the tapered suction roll cell is installed so as to be freely detachable and attachable, preferably from the operational side, and a backing wire, and where necessary, a further face wire are installed at the outer peripheral surface thereof.

32. A paper web manufacturing device employing a detachable cylinder, wherein one end is either directly affixed to an operational side frame as a central fixed axle, or is affixed via an operational side drainage pipe rotational bearing, while the other end is affixed to a drive side frame as a central drainage pipe having a plurality of drainage openings in the central outer peripheral part thereof, and at the outer periphery thereof, a tapered suction roll cell, the outer peripheral surface of which is inclined, preferably toward the operational side in the axial direction, is affixed on an operational side frame at the operational side via an operational side rotational axle and an operational side rotational axle bearing, and on a drive side frame via a drive side rotational axle and a drive side rotational axle bearing in a finely adjustable manner in the vertical direction by means of an internal lifter, and a tapered suction roll sleeve having an inner peripheral surface having an inclination equal to that of the outer circumference of the tapered suction roll cell and having an outer peripheral surface forming a cylinder having a freely selected diameter, which is divided into two or more parts, and which is freely expandable and contractible in the inward and outward peripheral directions by a connecting means is installed so as to be freely detachable and attachable, preferably from the operational side, and a backing wire, and where necessary, a further face wire, are installed at the outer peripheral surface thereof, and this is rotated at a circumferencial speed which is either approximately equal to that of the fourdrinier wire or within plus or minus 6% thereof.

33. A paper web manufacturing device in accordance with claim 30, wherein, as the tapered suction roll sleeve, a plurality of rings divided approximately semicircularly into two pieces, having the same outer diameter and having inner circumferences which are reduced in size in a stepwise manner, are affixed at approximately equal spacings by means of axial direction reinforcing ribs, wire is wrapped around the outer circumference thereof, thus forming a pair of perforated semicylindrical pipes having an inner circumferencial taper which have the requisite width and diameter, and furthermore, both ends of the two-piece rings described above are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

34. A paper web manufacturing device in accordance with claim 32, wherein, as the tapered suction roll sleeve, a plurality of rings divided approximately semicircularly into two pieces, having the same outer diameter and having inner circumferences which are reduced in size in a stepwise manner, are affixed at approximately equal spacings by means of axial direction reinforcing ribs, wire is wrapped around the outer circumference thereof, thus forming a pair of perforated semicylindrical pipes having an inner circumferencial taper which have the requisite width and diameter, and furthermore, both ends of the two-piece rings described above are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

35. A paper web manufacturing device in accordance with claim 30, wherein, as the tapered suction roll sleeve, a plurality of rings divided approximately semicircularly into two pieces, having the same outer diameter and having inner circumferences which are reduced in size in a stepwise manner, are affixed at approximately equal spacings together with axial direction reinforcing ribs to the inner peripheral surface of a suction cylinder perforated shell having a plurality of holes, thus forming a pair of perforated semicylindrical pipes having an inner circumferencial taper which have the requisite width and diameter, and furthermore, both ends of the two-piece rings described above are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

36. A paper web manufacturing device in accordance with claim 32, wherein, as the tapered suction roll sleeve, a plurality of rings divided approximately semicircularly into two pieces, having the same outer diameter and having inner circumferences which are reduced in size in a stepwise manner, are affixed at approximately equal spacings together with axial direction reinforcing ribs to the inner peripheral surface of a cylinder perforated shell having a plurality of holes, thus forming a pair of perforated semicylindrical pipes having an inner circumferencial taper which have the requisite width and diameter, and furthermore, both ends of the two-piece rings described above are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

37. A paper web manufacturing device in accordance with claim 30, wherein both ends of the rings are extended slightly in an arc shape, and both ends thereof are connected via affixing tapered holes and connecting pins which engage in these affixing tapered holes so that the space between both ends is expandable and contractible, and the rings form a circular shape when the space between both ends is expanded.

38. A paper web manufacturing device in accordance with claim 32, wherein both ends of the rings are extended slightly in an arc shape, and both ends thereof are connected via affixing tapered holes and connecting pins which engage in these affixing tapered holes so that the space between both ends is expandable and contractible, and the rings form a circular shape when the space between both ends is expanded.

39. A paper web manufacturing in accordance with claim 30, wherein a pair of perforated semicircular pipes with an inner circumferencial taper have a plurality of holes in the outer peripheral surface thereof, and preferably having a plurality of void grooves in the inner peripheral surface thereof, is used as the tapered suction roll sleeve, and furthermore, both ends thereof are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

40. A paper web manufacturing in accordance with claim 32, wherein a pair of perforated semicircular pipes with an inner circumferencial taper formed in a unitary manner by means of a method such as bending, casting or winding or the like, and having a plurality of holes in the outer peripheral surface thereof, and preferably having a plurality of void grooves in the inner peripheral surface thereof, is used as the tapered suction roll sleeve, and furthermore, both ends thereof are connected via affixing tapered holes and connecting pins which engage in these affixing tapered holes so that the distance between the two ends is expandable and reducible, and when the distance between the two ends is expanded, the rings form a circular shape, and may be attached to and detached from the tapered suction roll cell by means of a screw nut or a hydraulic withdraw and insert means.

41. A paper web manufacturing device, which is provided with a roll cell having an outer peripheral surface which is a conical surface and a cylindrical roll sleeve which has an inner peripheral surface which is in contact with the outer peripheral surface of the roll cell, and which is a conical surface agreeing with the conical surface, and a means for deforming the roll sleeve in the radial direction is provided on the roll sleeve, and penetrating holes which penetrate in the radial direction are formed in the roll cell and roll sleeve.

42. A paper web manufacturing device in accordance with claim 41, wherein an endless forming wire is wrapped around the roll sleeve.

43. A paper web manufacturing device in accordance with claim 41, wherein a plurality of the penetrating holes are formed in the roll cell and the roll sleeve.

44. A paper web manufacturing method, wherein a pulp suspension is supplied to the surface of the endless forming wire of claim 42 which is wrapped around the roll sleeve, and by means of the pressure difference on the front and rear of the former wire, a paper web is formed on the surface of the former wire.

45. A paper web manufacturing method in accordance with claim 44, wherein a former roll having a roll sleeve around which is wrapped the endless forming wire is in contact with the top of the paper web formed on the surface of the forming wire, and dehydration of the paper web is conducted via the former roll.

46. A paper web manufacturing method, having a paper web forming process in which a pulp suspension is supplied to the surface of a forming wire and, as a result of the pressure difference between the front and back of the forming wire, a paper web is formed on the surface of the forming wire, and a compression process in which the paper web formed is compressed, wherein a former roll in accordance with claim 45 is brought into contact with at least one of the rotating bodies in contact with the paper web in at least one of the paper web forming process and the compression process.

47. A paper web manufacturing method employing a roll cell having an outer peripheral surface which is a conical surface, a roll sleeve which is formed in a cylindrical manner and which has an inner peripheral surface, which is in contact with the outer peripheral surface of the roll cell, which is a conical surface which is in agreement with the conical surface described above, and a forming wires which are endless and are wrapped around the roll sleeve; wherein a process is provided in which another forming wire is moved along the axial line of the roll sleeve and overlays the roll sleeve, and a process is provided in which the roll sleeve which has the forming wire overlaid thereon is outwardly deformed in the radial direction, and the outer peripheral surface of the roll sleeve is brought into contact with the inner peripheral surface of the forming wire.

* * * * *